US007220522B2

(12) United States Patent
Ikegami et al.

(10) Patent No.: US 7,220,522 B2
(45) Date of Patent: May 22, 2007

(54) ELECTROPHOTOGRAPHIC PHOTORECEPTOR, METHOD FOR MANUFACTURING THE ELECTROPHOTOGRAPHIC PHOTORECEPTOR, AND IMAGE FORMING METHOD, IMAGE FORMING APPARATUS AND PROCESS CARTRIDGE USING THE ELECTROPHOTOGRAPHIC PHOTORECEPTOR

(75) Inventors: Takaaki Ikegami, Susono (JP); Tomoyuki Shimada, Suntoh-gun (JP); Yasuo Suzuki, Fuji (JP)

(73) Assignee: Ricoh Company Limited, Tokyo (JP)

( * ) Notice: Subject to any disclaimer, the term of this patent is extended or adjusted under 35 U.S.C. 154(b) by 329 days.

(21) Appl. No.: 10/792,607

(22) Filed: Mar. 4, 2004

(65) Prior Publication Data

US 2004/0180280 A1 Sep. 16, 2004

(30) Foreign Application Priority Data

Mar. 4, 2003 (JP) ..... 2003-057682

(51) Int. Cl.
*G03G 5/00* (2006.01)

(52) U.S. Cl. ..... 430/73; 430/58.25; 430/126; 399/159

(58) Field of Classification Search ..... 430/73, 430/58.25, 126; 399/159
See application file for complete search history.

(56) References Cited

U.S. PATENT DOCUMENTS 3,730,712 A * 5/1973 Futaki et al. ..... 430/72
6,861,188 B2 * 3/2005 Ikegami et al. ..... 430/58.65

FOREIGN PATENT DOCUMENTS

| | | |
|---|---|---|
| JP | 53-133444 | 11/1978 |
| JP | 55-157748 | 12/1980 |
| JP | 57-30846 | 2/1982 |
| JP | 60-196768 | 10/1985 |
| JP | 2-4275 | 1/1990 |
| JP | 3-96961 | 4/1991 |
| JP | 4-281461 | 10/1992 |
| JP | 2000-66434 | 3/2000 |
| JP | 2000-231204 | 8/2000 |

OTHER PUBLICATIONS

U.S. Appl. No. 11/366,469, filed Mar. 3, 2006, Sugino et al.
U.S. Appl. No. 11/317,302, filed Dec. 27, 2005, Takada et al.
U.S. Appl. No. 11/229,749, filed Sep. 20, 2005, Ohshima et al.

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A photoreceptor including a photosensitive layer including a specific diamine compound, or a photoreceptor including an electroconductive substrate; a photosensitive layer located overlying the electroconductive substrate; and optionally a protective layer located overlying the photosensitive layer, wherein an outermost layer of the photoreceptor includes a filler, an organic compound having an acid value of from 10 to 700 mgKOH/g and a specific diamine compound. An image forming method, an image forming apparatus and a process cartridge using the photoreceptor are also provided. A method for manufacturing the photoreceptor including the steps of preparing a coating liquid including the filler, the organic compound, the specific diamine compound and an antioxidant; and coating the coating liquid is also provided.

31 Claims, 6 Drawing Sheets

ELECTROPHOTOGRAPHIC PHOTORECEPTOR, METHOD FOR MANUFACTURING THE ELECTROPHOTOGRAPHIC PHOTORECEPTOR, AND IMAGE FORMING METHOD, IMAGE FORMING APPARATUS AND PROCESS CARTRIDGE USING THE ELECTROPHOTOGRAPHIC PHOTORECEPTOR

BACKGROUND OF THE INVENTION

1. Field of the Invention

The present invention relates to an electrophotographic photoreceptor. In addition, the present invention also relates to a method for manufacturing the electrophotographic photoreceptor, and an electrophotographic image forming method and apparatus and a process cartridge using the electrophotographic photoreceptor.

2. Discussion of the Background

Recently, development of the information processing systems using electrophotography is remarkable. In particular, improvement in the print qualities and reliability of laser printers and digital copiers, in which image information is recorded using light after information is converted to digital signals, is remarkable. In addition, the technique is applied to full color laser printers and full color digital copiers while being combined with a high speed recording technique. Therefore, a need exists for a photoreceptor which can produce high quality images while having a good durability.

As the electrophotographic photoreceptor (hereinafter referred to as a photoreceptor) for use in electrophotographic image forming apparatus, inorganic photoreceptors using a material such as selenium or amorphous silicon and organic photoreceptors are known. Among these photoreceptors, organic photoreceptors have been typically used now because of having low costs and good productivity and being non-polluting.

Specific examples of the organic photoreceptors include photoreceptors having the following photosensitive layers:

(1) photosensitive layers including a photoconductive resin typified by polyvinylcarbazole (PVK);

(2) photosensitive layers including a charge transfer complex typified by polyvinylcarbazole-2,4,7-trinitrofluorenon (PVK-TNF);

(3) photosensitive layers including a pigment dispersion typified by a phthalocyanine-binder system; and (4) functionally-separated photosensitive layers using a combination of a charge generation material and a charge transport material.

Among these organic photoreceptors, the functionally-separated photoreceptors are widely used now because of having high photosensitivity, good durability and good flexibility in selecting appropriate charge generation materials and charge transport materials.

The mechanism of forming an electrostatic latent image on a functionally-separated photoreceptor is as follows:

(1) when imagewise light irradiates a charged photoreceptor, the imagewise light is absorbed by a charge generation material in a charge generation layer after passing through a transparent charge transport layer located overlying the charge generation layer;

(2) the charge generation material absorbing light generates a charge carrier;

(3) the charge carrier is injected into the charge transport layer and transported through the charge transport layer (or the photosensitive layer) due to an electric field generated by the charge formed on the surface of the photoreceptor; and (4) the charge carrier neutralizes the charge on the surface of the photoreceptor, resulting in formation of an electrostatic latent image.

However, organic photoreceptors have drawbacks in that the photosensitive layers thereof are greatly abraded after repeated use, thereby deteriorating the potential formed on the photoreceptors and photosensitivity thereof, and in addition the resultant images have background development caused by scratches on the surface of the photoreceptor and low image density. Therefore, it has been attempted to improve the abrasion resistance of photoreceptors. In addition, recently electrophotographic image forming apparatus are required to be small in size and to perform high speed image formation. Therefore, the photoreceptors for use in such image forming apparatus need to have good durability.

In attempting to improve the durability of photoreceptors, the following methods have been proposed:

(1) a protective layer having good lubricity is formed as an outermost layer;

(2) a crosslinked protective layer is formed as the outermost layer; and (3) a protective layer including a filler is formed as outermost layer.

Among these methods, the third method is effective at improving the durability of the photoreceptors. However, when a filler having a high insulation property is included in the protective layer, the resistance of the photoreceptor increases, and thereby a problem of serious increase in residual potential (hereinafter referred to as a residual potential increasing problem) is caused. This problem is considered to be caused by increase in resistance thereof and number of charge trap sites therein. In contrast, when an electroconductive filler is used in the protective layer, the resistance of the photoreceptor decreases, and therefore the problem of serious increase in residual potential is not caused. However, other problems such that outlines of the resultant images blur (hereinafter referred to as a blurred image problem), and thereby image qualities deteriorate.

Therefore, a technique in that a filler having a relatively low insulation property is used for the protective layer while the photoreceptor is heated by a heater such as drum heaters to prevent occurrence of the blurred image problem. In this case, the blurred image problem can be avoided, but the diameter of the photoreceptor has to be increased. Therefore, this technique cannot be applied to photoreceptors having a small diameter and small-sized image forming apparatus); In addition, by using a drum heater, the resultant image forming apparatus have the following drawbacks:

(1) the electric power consumption of the image forming apparatus increases; and (2) the waiting time (i.e., the time needed for activating the image forming apparatus from switching on) is long.

In contrast, when a filler having a high insulation property is used, the residual potential increasing problem occurs. In this case, the potential of lighted portions of the photoreceptor increases, and thereby the image density and halftone property of the resultant images deteriorate. In attempting to solve this problem, a technique in that the potential of non-lighted portions of the photoreceptor is increased is proposed. However, in this case, other problems such that background development is caused due to increase in electric field formed on the photoreceptor, and the life of the photoreceptor is shortened occur.

In addition, in attempting to solve the residual potential increasing problem, published examined Japanese Patent Applications Nos. 44-834, 43-16198 and 49-10258 have disclosed techniques in that a protective layer having a photoconductivity is formed as an outermost layer. However, the photoreceptors have a drawback in that the quantity of the imagewise light reaching the photosensitive layer located below the protective layer decreases because the protective layer absorbs the irradiated light, resulting in deterioration of the photosensitivity of the photoreceptor.

In attempting to improve the abrasion resistance, published unexamined Japanese Patent Application No. (hereinafter referred to as JOP) 57-30846 discloses a photoreceptor in which a protective layer including a filler such as a metal or a metal oxide, which has a particle diameter not greater than 0.3 μm, is formed as an outermost layer of the photoreceptor, to increase the transparency of the protective layer (i.e., to prevent increase of residual potential). By using this method, the increase of residual potential can be prevented to some extent. However, the effect is insufficient, and the residual potential increasing problem cannot be fully solved. This is because the problem is mainly caused by charge trapping by the added filler, which depends on the dispersion conditions of the filler in the protective layer. Even when the particle diameter of the filler is greater than 0.3 μm, the transparency of the resultant protective layer can be increased if the filler has good dispersibility. In contrast, even when the particle diameter is not greater than 0.3 μm, the transparency of the resultant protective layer is low if the filler has poor dispersibility.

Further, JOP 4-281461 discloses a photoreceptor, in which a charge transport material is included in a protective layer together with a filler to prevent increase of residual potential while maintaining good abrasion resistance. By including a charge transport material in the protective layer, the mobility of charges in the protective layer can be improved and thereby the increase of residual potential can be prevented to some extent. However, as mentioned above, the problem is mainly caused by increase in number of charge trapping sites, and therefore, there is a limitation on the residual potential improving effect by this method. Therefore, in this case, the thickness of the protective layer and the content of filler in the protective layer have to be decreased, and thereby good durability cannot be imparted to the resultant photoreceptor.

Further, in attempting to solve the residual potential increasing problem, JOP 53-133444 discloses a photoreceptor in which a Louis acid is included in the protective layer; JOP 55-157748 discloses a photoreceptor in which an organic proton acid is included in a protective layer together with a filler; JOP 2-4275 discloses a photoreceptor in which an electron accepting material is included in a protective layer; and JOP 2000-66434 discloses a photoreceptor in which a wax having an acid value not greater than 5 mgKOH/g is included in the protective layer.

By using these methods, the injection property of charges at the interface between the protective layer and the charge transport layer can be improved, because portions having a relatively low resistance are formed in the protective layer and thereby the charges can easily reach the surface of the protective layer. However, these photoreceptors have a drawback in that the blurred image problem is caused. In addition, when an organic acid is included in the protective layer, dispersibility of the filler deteriorates, and thereby good residual potential improving effect cannot be produced.

In order to produce high quality images using a photoreceptor having a filler-containing protective layer, not only occurrence of the residual potential increasing problem and the blurred image problem has to be prevented, but also the photoreceptor has to have a property such that charges generated in the photoreceptor can linearly reach the surface of the photoreceptor without being obstructed by the filler in the protective layer.

Whether or not charges can linearly advance through the protective layer depends on the dispersibility of the filler in the protective layer. Specifically, when the filler in the protective layer is aggregated, advancement of the charges, which are injected into the protective layer from the charge transport layer, to the surface of the protective layer is obstructed by the filler in the protective layer. As a result, toner particles are scattered in the resultant toner image, resulting in serious deterioration of the resolution of the toner image.

In addition, in a case where image writing light is scattered at the filler included in the protective layer and thereby the light transmission is deteriorated, the resolution of the resultant toner images is also deteriorated. The scattering of image writing light also changes depending on the dispersion conditions of the filler in the protective layer.

Further, the dispersion conditions of the filler in the protective layer greatly influence on the abrasion resistance of the protective layer. Specifically, a filler is unevenly dispersed in the protective layer, the abrasion resistance of the protective layer deteriorates.

Therefore, in the photoreceptor having a protective layer in which a filler is dispersed to improve the durability of the photoreceptor, it is important to improve the dispersibility of the filler therein.

However, there is no photoreceptor which includes a filler-containing protective layer and which can produce high quality images without causing the blurred image problem and the residual potential increasing problem while having good durability. As mentioned above, when a drum heater is used for preventing occurrence of the blurred image problem, other problems in that the image forming apparatus becomes large in size, and the power consumption thereof increases are caused.

JOP 2000-231204 discloses an aromatic compound having dialkylamino group which serves as an acid scavenger. It is described therein that this compound is effective at improving image qualities after repeated use, namely effective at solving the blurred image problem caused by oxidizing materials. However, the compound has poor charge transport ability, and therefore the compound cannot be used for photoreceptors for use in high speed image forming apparatus. Therefore, the compound cannot be included in a photoreceptor in a small quantity, and thereby the effect is little.

Further, JOP 60-196768 and Japanese Patent No. 2884353 (i.e., JOP 03-96961) have disclosed stilbene compounds having a dialkylamino group. It is reported by Itami et al. in Konica technical Report, Vol. 13, P 37, 2000 that the compounds are effective at improving the blurred image problem. However, the dialkylamino group of the stilbene compounds has a strong mesomeric effect (i.e., +M effect) against the triaryl amine structure which is a charge transport site. Therefore, the ionization potential of the entire system seriously decreases. Therefore the charge retaining ability of the charge transport material therein deteriorates at the beginning or after repeated use. Therefore the photoreceptor is not practically used. Even if the stilbene compounds are used together with other charge transport materials, the resultant photoreceptors have very low photosensitivity and high residual potential. This is because the ionization potential of the stilbene compounds is very low relative to that of the charge transport materials and therefore the stilbene compounds serve as trap sites.

Because of these reasons, a need exists for a photoreceptor which has good durability and which can produce high quality images without causing the blurred image problem and the residual potential increasing problem.

SUMMARY OF THE INVENTION

Accordingly, an object of the present invention is to provide a photoreceptor which has good durability and which can produce high quality images without causing the blurred image problem and the residual potential increasing problem, and a method for manufacturing the photoreceptor.

Another object of the present invention is to provide an image forming method by which high quality images can be produced at a high speed for a long period of time without frequently changing the photoreceptor.

Yet another object of the present invention is to provide an image forming apparatus and a process cartridge, which is small in size and which can produce high quality images at a high speed for a long period of time without frequently changing the photoreceptor.

Briefly these objects and other objects of the present invention as hereinafter will become more readily apparent can be attained by a photoreceptor which includes an electroconductive substrate, and at least a photosensitive layer located overlying the substrate, wherein the photosensitive layer includes a diamine compound having the following formula (1):

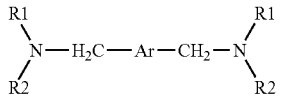

(1)

wherein R1 and R2 independently represent a substituted or unsubstituted alkyl group, or a substituted or unsubstituted aromatic hydrocarbon group, wherein at least one of R1 and R2 is a substituted or unsubstituted aromatic hydrocarbon group and R1 and R2 optionally share bond connectivity to form a substituted or unsubstituted ring including a nitrogen atom; and Ar represents a substituted or unsubstituted aromatic hydrocarbon group.

Alternatively, the outermost layer of the photoreceptor includes at least one of an organic compound having an acid value of from 10 to 700 mgKOH/g and the diamine compound having formula (1).

The outermost layer is defined as the layer furthest away from the substrate. The photosensitive layer can be the outermost layer. "Overlying" can include direct contact and allow for intermediate layers.

The outermost layer may be the photosensitive layer, or an outermost layer of the photosensitive layer when the photosensitive layer is constituted of plural layers.

Alternatively, the outermost layer may be a protective layer formed overlying the photosensitive layer.

The organic compound having an acid value of from 10 to 700 mgKOH/g is preferably a polycarboxylic acid. As the polycarboxylic acid, polyester resins, acrylic resins, copolymers including one or more units of the polyester resins and acrylic resins, and mixtures thereof, which include carboxyl group, can be preferably used. The polycarboxylic acid is preferably used together with a fatty acid.

The filler is preferably an inorganic pigment. The inorganic pigment preferably includes a metal oxide. The inorganic pigment preferably has a pH not less than 5 and/or a dielectric constant not less than 5. In addition, the filler preferably has an average primary particle diameter of from 0.01 to 0.5 μm.

The outermost layer preferably includes a charge transport material. The charge transport material is preferably a charge transport polymer material. The outermost layer preferably includes at least one of polycarbonate resins and polyarylate resins. The outermost layer preferably includes an antioxidant. The antioxidant is preferably one of hydroquinone compounds and hindered amine compounds.

As another aspect of the present invention, an image forming method is provided which includes charging the photoreceptor mentioned above; irradiating the charged photoreceptor with imagewise light to form an electrostatic latent image on the photoreceptor; developing the electrostatic latent image with a developer including a toner to form a toner image on the photoreceptor; and transferring the toner image on a receiving material.

As yet another aspect of the present invention, an image forming apparatus is provided which includes a photoreceptor; a charger configured to charge the photoreceptor; a light irradiator configured to irradiate the charged photoreceptor with imagewise light to form an electrostatic latent image on the photoreceptor; an image developer configured to develop the electrostatic latent image with a developer to form a toner image on the photoreceptor; and a transferring device configured to transfer the toner image onto a receiving material. The light irradiator preferably includes a laser diode (LD) or a light emitting diode (LED) as a light source.

As a further aspect of the present invention, a process cartridge is provided which includes the photoreceptor and at least one of a charger, a light irradiator, an image developer, a transfer device, a cleaner configured to clean the surface of the photoreceptor, and a discharger configured to discharge the charges remaining on the photoreceptor after the image transferring process.

As a still further aspect of the present invention, a method for manufacturing the photoreceptor is provided which includes the steps of coating an outermost layer coating liquid including at least a solvent, a filler, an organic compound having an acid value of from 10 to 700 mgKOH/g, a compound having formula (1) and an antioxidant, preferably selected from the group consisting of hydroquinone compounds and hindered amine compounds.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The photoreceptor of the present invention includes an electroconductive substrate, and at least a photosensitive layer located which is located overlying the substrate and which includes a compound having the above-mentioned formula (1). Alternatively, the outermost layer of the photoreceptor (i.e., the layer furthest away from the substrate) includes a filler, an organic compound having an acid value of from 10 to 700 mgKOH/g and a compound having formula (1). The photoreceptor of the present invention will be explained referring to drawings.

Figure 1:
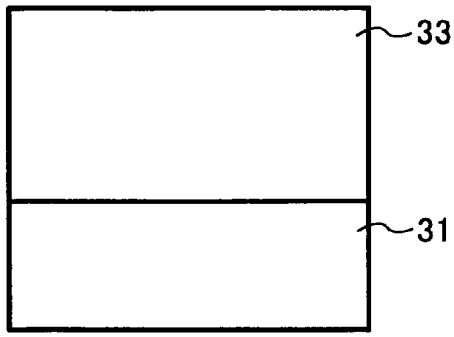
FIGS. 1 to 5 are schematic views illustrating the cross sections of typical embodiments of the photoreceptor of the present invention.

FIG. 1 is a schematic view illustrating the cross section of an embodiment of the photoreceptor of the present invention.

In FIG. 1, a single-layer photosensitive layer 33 including a charge generation material (hereinafter a CGM) and a charge transport material (hereinafter a CTM) as main components is formed on an electroconductive substrate 31. The photosensitive layer 33 further includes a compound having formula (1). Alternatively, when the photosensitive layer 33 is an outermost layer of this photoreceptor, the layer 33 includes a filler, an organic compound having an acid value of from 10 to 700 mgKOH/g and a compound having formula (1) as well as the CGM and CTM.

Figure 2:
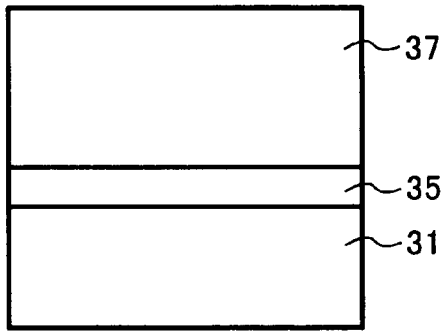

FIG. 2 is a schematic view illustrating the cross section of another embodiment of the photoreceptor of the present invention.

In FIG. 2, a charge generation layer (hereinafter a CGL) 35 including a CGM as a main component and a, charge transport layer (hereinafter a CTL) 37 including a CTM as a main component are overlaid on an electroconductive substrate 31 in this order.

The CTL 37 includes a compound having formula (1). Alternatively, when the CTL 37 is an outermost layer of this photoreceptor, the CTL includes a filler, an organic compound having an acid value of from 10 to 700 mgKOH/g and a compound having formula (1) as well as the CTM. The filler may be included uniformly in the CTL 37 or included such that the concentration of the filler increases in the upward direction of the CTL 37.

Figure 3:
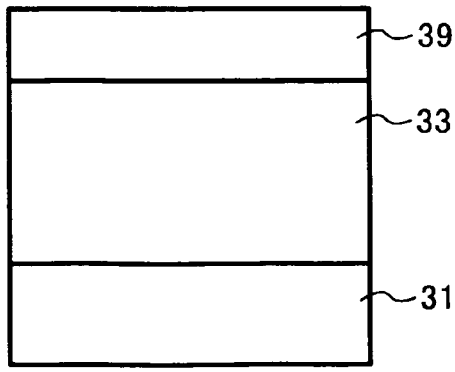

FIG. 3 is a schematic view illustrating the cross section of yet another embodiment of the photoreceptor of the present invention.

In FIG. 3, a photosensitive layer 33 which includes a CGM and a CTM as main components is formed on an electroconductive substrate 31, and a protective layer 39 is formed on the photosensitive layer 33. The photosensitive layer 33 includes a compound having formula (1). Alternatively, the protective layer 39, which is the outermost layer of this photoreceptor, includes at least a filler, an organic compound having an acid value of from 10 to 700 mgKOH/g and a compound having formula (1).

Figure 4:
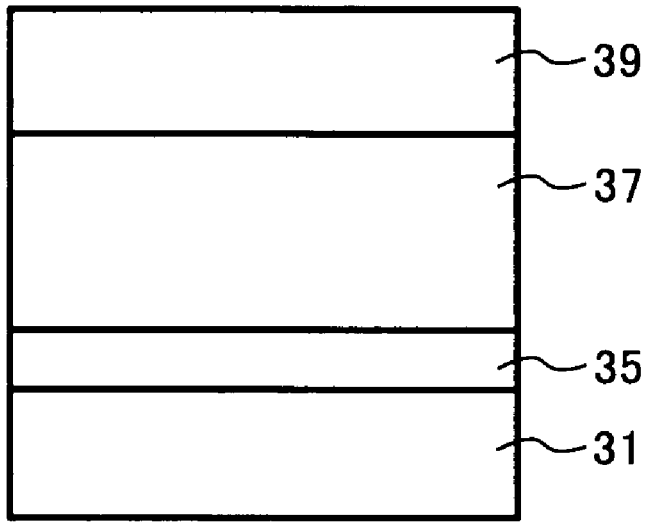

FIG. 4 is a schematic view illustrating the cross section of a further embodiment of the photoreceptor of the present invention.

In FIG. 4, a CGL 35 including a CGM as a main component and a CTL 37 including a CTM as a main component are overlaid on an electroconductive substrate 31 in this order. In addition, a protective layer 39 is formed on the CTL 37. The CTL 37 includes a compound having formula (1). Alternatively, the protective layer 39, which is the outermost layer of the photoreceptor, includes at least a filler, an organic compound having an acid value of from 10 to 700 mgKOH/g and a compound having formula (1).

Figure 5:
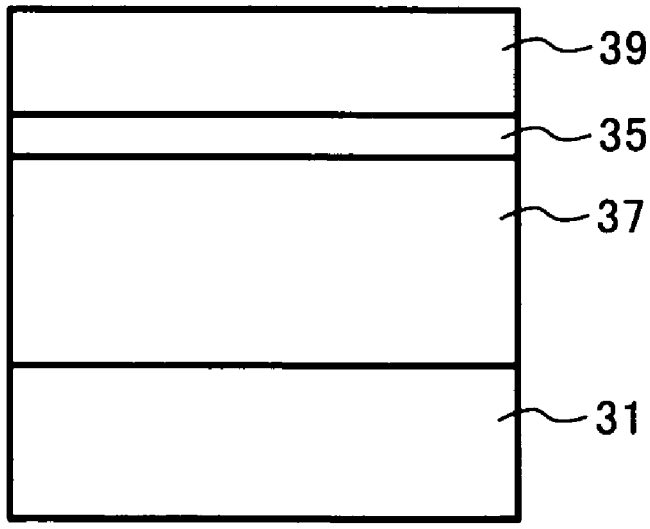

FIG. 5 is a schematic view illustrating the cross section of a still further embodiment of the photoreceptor of the present invention.

In FIG. 5, a CTL 37 including a CTM as a main component and a CGL 35 including a CGM as a main component are overlaid on an electroconductive substrate 31 in this order. In addition, a protective layer 39 is formed on the CGL 35. The CTL 37 includes a compound having formula (1). Alternatively, the protective layer 39, which is the outermost layer of this photoreceptor, includes at least a filler, an organic compound having an acid value of from 10 to 700 mgKOH/g and a compound having formula (1).

Suitable materials for use as the electroconductive substrate 31 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel can be used. A metal cylinder can also be used as the substrate 31, which is prepared by tubing a metal such as aluminum, aluminum alloys, nickel and stainless steel by a method such as impact ironing or direct ironing, and then subjecting the surface of the tube to cutting, super finishing, polishing and the like treatments. Further, endless belts of a metal such as nickel, stainless steel and the like, which have been disclosed, for example, in Japanese Laid-Open Patent Publication No. 52-36016, can also be used as the substrate 31.

Furthermore, substrates, in which a coating liquid including a binder resin and an electroconductive powder is coated on the supports mentioned above, can be used as the substrate 31. Specific examples of such an electroconductive powder include carbon black, acetylene black, powders of metals such as aluminum, nickel, iron, nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate 31.

Next, the photosensitive layer of the photoreceptor of the present invention will be explained.

In the photoreceptor of the present invention, the photosensitive layer may be a single-layered photosensitive layer or a multi-layered photosensitive layer.

At first, the multi-layered photosensitive layer including the CGL 35 and the CTL 37 will be explained.

The CGL 35 includes a CGM as a main component. In the CGL 35, known charge generation materials can be used. Specific examples of such CGMs include azo pigments such as monoazo pigments, disazo pigments, asymmetric disazo pigments and trisazo pigments; phthalocyanine pigments such as titanyl phthalocyanine, copperphthalocyanine, vanadylphthalbcyanine, hydroxygallium phthalocyanine and metal free phthalocyanine; perylene pigments, perynone pigments, indigo pigments, pyrrolopyrrole pigments, anthraquinone pigments, quinacridone pigments, quinone type condensed polycyclic compounds, squaric acid type dyes, and the like pigments and dyes. These CGMs can be used alone or in combination.

The CGL 35 is typically prepared by coating a CGL coating liquid, which is prepared by dispersing a CGM in a solvent optionally together with a binder resin using a dispersing machine such as ball mills, attritors, sandmills and supersonic dispersion machines, on an electroconductive substrate and then drying the coated liquid.

Suitable binder resins, which are optionally used in the CGL coating liquid, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins.

The content of the binder resin in CGL 35 is preferably from 0 to 500 parts by weight, and preferably from 10 to 300 parts by weight, per 100 parts by weight of the charge generation material included in the CGL 35.

A binder resin can be mixed before or after the dispersion process.

Suitable solvents for use in the CGL coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. These solvents can be used alone or in combination.

The CGL coating liquid includes a CGM, a solvent and a binder resin as main components, but may include additives such as sensitizers, dispersants, surfactants and silicone oils.

The CGL coating liquid can be coated by a coating method such as dip coating, spray coating, bead coating, nozzle coating, spinner coating and ring coating methods. The thickness of the CGL 35 is preferably from 0.01 to 5 μm, and more preferably from 0.1 to 2 μm.

Then the CTL 37 will be explained. The CTL 37 includes a CTM as a main component.

The CTL 37 can be typically formed by the following method:

(1) a CTM and a binder resin are dispersed or dissolved in a proper solvent to prepare a CTL coating liquid; and (2) the CTL coating liquid is coated and dried to form a CTL.

The CTL coating liquid may include one or more additives such as plasticizers, leveling agents, antioxidants and the like, if desired.

CTMs are classified into positive-hole transport materials and electron transport materials.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

In addition, the following compounds can be used as the electron transport material.

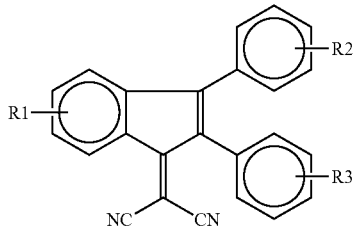

wherein R1, R2 and R3 independently represent a hydrogen atom, a halogen atom, a substituted or unsubstituted alkyl group, an alkoxy group or a substituted or unsubstituted phenyl group.

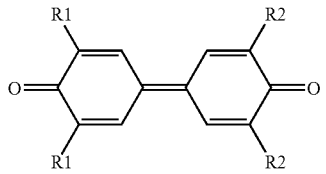

wherein R1 and R2 independently represent a hydrogen atom, a substituted or unsubstituted alkyl group, or a substituted or unsubstituted phenyl group.

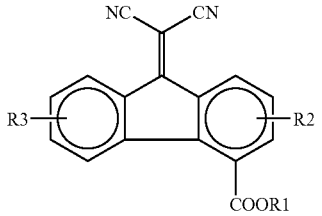

wherein R1, R2 and R3 independently represent a hydrogen atom, a halogen atom, a substituted or unsubstituted alkyl group, an alkoxy group or a substituted or unsubstituted phenyl group.

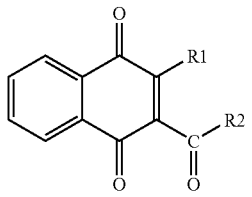

wherein R1 represents a substituted or unsubstituted alkyl group, or a substituted or unsubstituted aromatic hydrocarbon group; R2 represents a substituted or unsubstituted alkyl group, a substituted or unsubstituted aromatic hydrocarbon group, or the following group:

$$—O—R^3$$

wherein $R^3$ represents a substituted or unsubstituted alkyl group, or a substituted or unsubstituted aromatic hydrocarbon group.

Specific examples of the positive-hole transport materials include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like.

In addition, the following compounds can also be used as the positive-hole transport material.

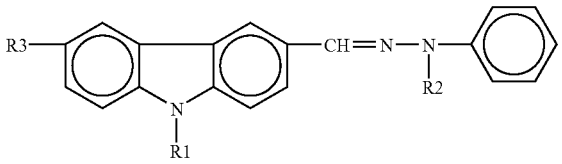

wherein R1 represents a methyl group, an ethyl group, a 2-hydroxyethyl group or a 2-chlorethyl group; and R2 represents a methyl group, an ethyl group, a benzyl group or a phenyl group; and R3 represents a hydrogen atom, a chlorine atom, a bromine atom, an alkyl group having 1 to 4 carbon atoms, an alkoxy group having 1 to 4 carbon atoms, a dialkylamino group or a nitro group.

Specific examples of the compounds include 9-ethylcarbazole-3-aldehyde-1-methyl-1-phenylhydrazone, 9-ethylcarbazole-3-aldehyde-1-benzyl-1-phenylhydrazone, 9-ethylcarbazole-3-aldehyde-1,1-diphenylhydrazone, etc.

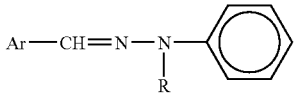

wherein Ar represents a naphthalene ring, an anthracene ring, a pyrene ring, which rings may be substituted, a pyridine ring, a furan ring or thiophene ring; and R represents an alkyl group, a phenyl group or a benzyl group.

Specific examples of the compounds include 4-diethylaminostyryl-β-aldehyde-1-methyl-1-phenylhydrazone, 4-methoxynaphthalene-1-aldehyde-1-benzyl-1-phenylhydrazone, etc.

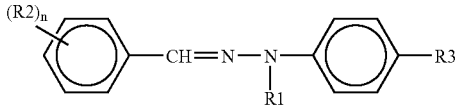

wherein R1 represents an alkyl group, a benzyl group, a phenyl group or a naphthyl group; R2 represents a hydrogen atom, an alkyl group having 1 to 3 carbon atoms, an alkoxy group having 1 to 3 carbon atoms, a dialkylamino group, diaralkylamino group or a substituted or unsubstituted diarylamino group; n is an integer of from 1 to 4, wherein when n is not less than 2, R2 may be the same or different from each other; and R3 represents a hydrogen atom or a methoxy group.

Specific examples of the compounds include 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, 4-benzylaminobenzaldehyde-1,1-diphenylhydrazone, etc.

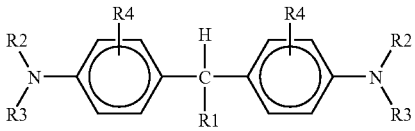

wherein R1 represents an alkyl group having 1 to 11 carbon atoms, a substituted or unsubstituted phenyl group or a heterocyclic ring group; each of R2 and R3 represents a hydrogen atom, an alkyl group having 1 to 4 carbon atoms, a hydroxyalkyl group, a chloroalkyl group or a substituted or unsubstituted aralkyl group, wherein R2 and R3 optionally share bond connectivity to form a heterocyclic ring group including a nitrogen atom; and each of R4 represents a hydrogen atom, an alkyl group having 1 to 4 carbon atoms, an alkoxy group or a halogen atom.

Specific examples of the compounds include 1,1-bis(4-dibenzylaminophenyl)propane, tris(4-diethylaminophenyl)methane, 2,2'-dimethyl-4,4'-bis(diethylamino)-triphenylmethane, etc.

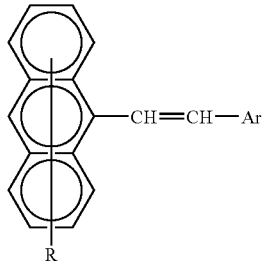

wherein R represents a hydrogen atom or a halogen atom; and Ar represents a substituted or unsubstituted phenyl group, a naphthyl group, an anthryl group or a carbazolyl group.

Specific examples of the compounds include 9-(-diethylaminostyryl)anthracene, 9-bromo-10-(4-diethylaminostyryl)aminoanthracene, etc.

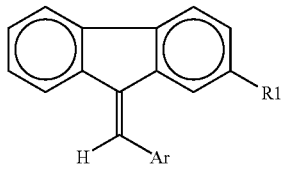

wherein R1 represents a hydrogen atom, a halogen atom, a cyano group, an alkoxy group having 1 to 4 carbon atoms or a alkyl group having 1 to 4 carbon atoms; and Ar represents a group having one of the following formulae:

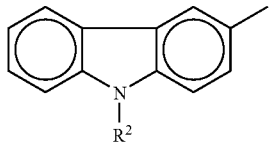

and

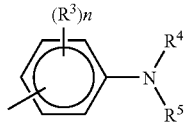

wherein $R^2$ represents an alkyl group having 1 to 4 carbon atoms; $R^3$ represents a hydrogen atom, a halogen atom, an alkyl group having 1 to 4 carbon atoms, an alkoxy group having 1 to 4 carbon atoms or a dialkylamino group; n is 1 or 2, wherein each of $R^3$ may be the same or different from the others when n is 2; and $R^4$ and $R^5$ independently represent a hydrogen atom, a substituted or unsubstituted alkyl group having 1 to 4 carbon atoms or a substituted or unsubstituted benzyl group.

Specific examples of the compounds include 9-(4-dimethylaminobenzylidene)fluorenone, 3-(9-fluorenylidene)-9-ethylcarbazole, etc.

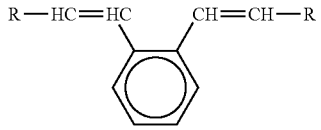

wherein R represents a carbazolyl group, a pyridyl group, a thienyl group, an indolyl group, a furyl group, a substituted or unsubstituted phenyl, a substituted or unsubstituted styryl, a substituted or unsubstituted naphtyl group or a substituted or unsubstituted anthryl group, wherein the substituent thereof is selected from the group consisting of a dialkylamino group, an alkyl group, an alkoxy group, a carboxyl group or its ester, a halogen atom, a cyano group, an aralkylamino group, a N-alkyl-N-aralkylamino group, an amino group, a nitro group and an acethylamino group.

Specific examples of the compounds include 1,2-bis(4-diethylaminostyryl)benzene, 1,2-bis(2,4-dimethoxystyryl)benzene, etc.

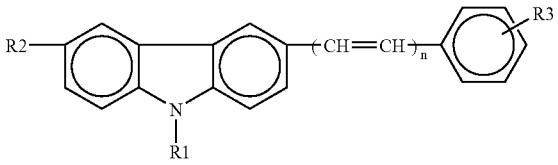

wherein R1 represents a lower alkyl group, a substituted or unsubstituted phenyl group or a benzyl group; R2 and R3 independently represent a hydrogen atom, a lower alkyl group, a lower alkoxy group, a halogen atom, a nitro group, an amino group or an amino group substituted with a lower alkyl group or a benzyl group; and n is 1 or 2.

Specific examples of the compounds include 3-styryl-9-ethylcarbazole, 3-(4-methoxystyryl)-9-ethylcarbazol, etc.

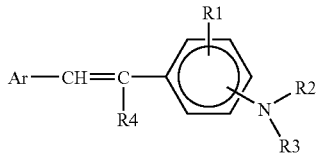

wherein R1 represents a hydrogen atom, an alkyl-group, an alkoxy group or a halogen atom; R2 and R3 independently represent a substituted or unsubstituted aromatic hydrocarbon group; R4 represents a hydrogen atom, a lower alkyl group or a substituted or unsubstituted phenyl group; and Ar represents a substituted or unsubstituted phenyl group or a naphthyl group.

Specific examples of the compounds include 4-diphenylaminostilbene, 4-dibenzylaminostilbene, 4-ditolylaminostilbene, 1-(4-diphenylaminostyryl)naphthalene, etc.

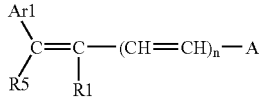

wherein n is 0 or 1; R1 represents a hydrogen atom, an alkyl group or a substituted or unsubstituted phenyl group; Ar1 represents a substituted or unsubstituted aromatic hydrocarbon group; R5 represents an alkyl group having from 1 to 4 carbon atoms, or a substituted or unsubstituted aromatic hydrocarbon group, wherein Ar1 and R5 optionally share bond connectivity to form a ring; and A represents a 9-anthryl group, a substituted or unsubstituted carbazolyl group or a group having one of the following formulae:

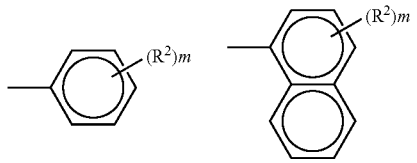

wherein R 2 represents a hydrogen atom, an alkyl group, an alkoxy group, a halogen atom or a group having a formula of —N($R^3$)($R^4$), wherein $R^3$ and $R^4$ independently represent a substituted or unsubstituted aromatic hydrocarbon group, and $R^3$ and $R^4$ optionally share bond connectivity to form a ring; and m is an integer of from 1 to 3, wherein when m is not less than 2, each of $R^2$ is the same or different from the others, wherein A and R1 optionally share bond connectivity to form a ring together when n is 0.

Specific examples of the compounds include 4'-diphenylamino-α-phenylstilbene, 4'-bis(4-methylphenyl)amino-α-phenylstilbene, etc.

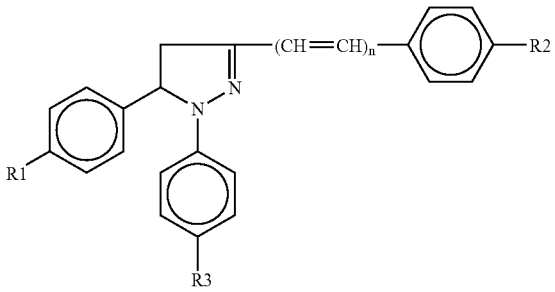

wherein R1, R2 and R3 represent a hydrogen atom, a lower alkyl group, a lower alkoxy group, a halogen atom or a dialkylamino group; and n is 0 or 1.

Specific examples of the compounds include 1-phenyl-3-(4-diethylaminostyryl)-5-(4-diethylaminophenyl)pyrazoline.

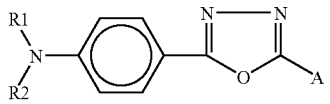

wherein R1 and R2 independently represent a substituted or unsubstituted alkyl group or a substituted or unsubstituted aromatic hydrocarbon group; and A represents a substituted amino group, a substituted or unsubstituted aromatic hydrocarbon group or an allyl group.

Specific examples of the compounds include 2,5-bis(4-diethylaminophenyl)-1,3,4-oxadiazole, 2-N,N-diphenylamino-5-(4-diphenylaminophenyl)-1,3,4-oxadiazole, 2-(4-dimethylaminophenyl)-5-(4-diethylaminophenyl)-1,3,4-oxadiazole, etc.

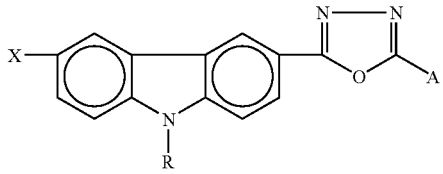

wherein X represents a hydrogen atom, a lower alkyl group or a halogen atom; R represents a substituted or unsubstituted alkyl group or a substituted or unsubstituted aromatic hydrocarbon group; and A represents a substituted amino group, or a substituted or unsubstituted aromatic hydrocarbon group.

Specific examples of the compounds include 2-N,N-diphenylamino-5-(N-ethylcarbazole-3-yl)-1,3,4-oxadiazole, 2-(4-diethylaminophenyl)-5-(N-ethylcarbazole-3-yl)-1,3,4-oxadiazole, etc.

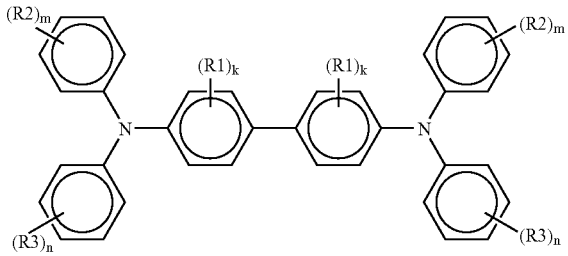

wherein R1 represents a lower alkyl group, a lower alkoxy group or a halogen atom; R2 and R3 independently represent a hydrogen atom, a lower alkyl group, a lower alkoxy group or a halogen atom; and k, m and n is independently 0 or an integer of from 1 to 4.

Specific examples of the compounds include N,N'-diphenyl-N,N'-bis(3-methylhenyl)-[1,1'-biphenyl]-4,4'-diamine, 3,3'-dimethyl-N,N,N',N'-tetrakis(4-methylphenyl)-[1,1'-biphenyl]-4,4'-diamine, etc.

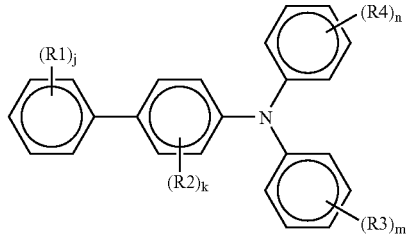

wherein R1, R3 and R4 independently represent a hydrogen atom, an amino group, an alkoxy group, a thioalkoxy group, an aryloxy group, a methylenedioxy group, a substituted or unsubstituted alkyl group, a halogen atom or a substituted or unsubstituted aromatic hydrocarbon group; R2 represents a hydrogen atom, an alkoxy-group, a substituted or unsubstituted alkyl group or a halogen atom; and j, k, m and n are independently an integer of from 1 to 4, wherein each of R1, R2, R3 and R4 may be the same or different from the others when j, k, m and n are an integer of from 2 to 4.

Specific examples of the compounds include 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, N,N-bis(3,4-dimethylphenyl)-[1,1'-biphenyl]-4-amine, etc.

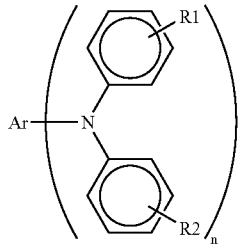

wherein Ar represents a condensation polycyclic hydrocarbon group having 18 or less carbon atoms which can have a substituent; and R1 and R2 independently represent a hydrogen atom, a halogen atom, a substituted or unsubstituted alkyl group, an alkoxy group, or a substituted or unsubstituted phenyl group and n is 1 or 2.

Specific examples of the compounds include N,N-diphenyl-pyrene-1-amine, N,N-di-p-tolyl-pyrene-1-amine, N,N-di(p-tolyl)-naphthylamine, N,N-di(p-tolyl)-1-phenanthrylamine, 9,9-dimethyl-2-(di-p-tolylamino)fluorenone, N,N,N',N'-tetrakis(4-methylphenyl)-phenanthrene-9,10-diamine, N,N,N',N'-tetrakis(3-methylphenyl)-m-phenylenediamine, etc.

A-CH═CH—Ar—CH═CH-A wherein Ar represents a substituted or unsubstituted aromatic hydrocarbon group; and A represents

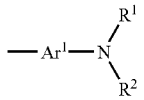

wherein $Ar^1$ represents a substituted or unsubstituted aromatic hydrocarbon group; and $R^1$ and $R^2$ represent substituted or unsubstituted alkyl group or a substituted or unsubstituted aromatic hydrocarbon group.

Specific examples of the compounds include 1,4-bis(4-diphenylaminostyryl)benzene, 1,4-bis[4-di(p-tolyl)aminostyryl]benzene, etc.

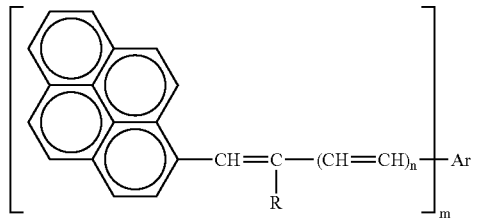

wherein Ar represents a substituted or unsubstituted aromatic hydrocarbon group; R represents a hydrogen atom, a substituted or unsubstituted alkyl group or a substituted or unsubstituted aromatic hydrocarbon group; and n is 0 or 1, and m is 1 or 2, wherein Ar and R optionally share bond connectivity to form a ring when n is 0 and m is 1.

Specific examples of the compounds include 1-(4-diphenylaminostyryl)pyrene, 1-(N,N-di-p-tolyl-4-aminostyryl)pyrene, etc.

These CTMs can be used alone or in combination.

Specific examples of the binder resin for use in the CTL 37 include known thermoplastic resins and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The content of the CTM in the CTL 37 is preferably from 20 to 300 parts by weight, and more preferably from 40 to 150 parts by weight, per 100 parts by weight of the binder resin included in the CTL 37. The thickness of the CTL 37 is preferably not greater than 25 μm in view of resolution of the resultant images and response (i.e., photosensitivity) of the resultant photoreceptor. In addition, the thickness of the CTL 37 is preferably not less than 5 μm in order that the resultant photoreceptor has a sufficient potential when charged. The lower limit of the thickness changes depending on the image forming system for which the photoreceptor is used.

Suitable solvents for use in the CTL coating liquid include tetrahydrofuran, dioxane, toluene, dichloromethane, monochlorobenzene, dichloroethane, cyclohexanone, methyl ethyl ketone, acetone and the like solvents. These solvents can be used alone or in combination.

When the CTL 37 is the outermost layer (i.e., the layer farthest from the substrate 31), the CTL 37 includes a filler, an organic compound having an acid value of from 10 to 700 mgKOH/g, and a compound having the following formula (1):

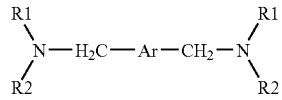

(1)

wherein R1 and R2 independently represent a substituted or unsubstituted alkyl group, or a substituted or unsubstituted aromatic hydrocarbon group, wherein at least one of R1 and R2 is a substituted or unsubstituted aromatic hydrocarbon group and R1 and R2 can optionally share bond connectivity to form a substituted or unsubstituted ring including a nitrogen atom; and Ar represents a substituted or unsubstituted aromatic hydrocarbon group.

As the filler to be added to the outermost layer of the photoreceptor to improve the abrasion resistance of the photoreceptor, organic fillers and inorganic fillers can be used. Suitable organic fillers include powders of fluorine-containing resins such as polytetrafluoroethylene, silicone resin powders, amorphous carbon powders, etc.

Specific examples of the inorganic fillers include powders of metals such as copper, tin, aluminum and indium; metal oxides such as silica, tin oxide, zinc oxide, titanium oxide, alumina, zirconia, indiumoxide, antimonyoxide, bismuth oxide, calcium oxide, tin oxide doped with antimony, indium oxide doped with tin; metal fluoride such as tin fluoride, calcium fluoride and aluminum fluoride; potassium titanate, boron nitride, etc.

Among these fillers, inorganic fillers are preferably used because of having high hardness.

When the CTL 37 of the photoreceptor having a structure as illustrated in FIG. 2 includes such a filler as mentioned above, the resultant photoreceptor has good durability but the blurred image problem and the residual potential increasing problem are caused. The present inventors discover that by including a filler having a high insulation property in the protective layer, occurrence of the blurred image problem can be prevented, and in addition by including an organic compound having an acid value of from 10 to 700 mgKOH/g therein, occurrence of the residual potential increasing problem can be prevented. The residual potential is decreased by using a compound having such a specific acid value. However, improvement in the dispersibility of the filler in the resultant layer, which is caused by addition of the specific compound, also influences on the decrease of residual porential. Since the dispersibility of the filler can be improved, the light transmittance of the CTL 37 can be improved, and thereby images having uniform image density can be produced, resulting in formation of high quality images. In addition, the abrasion resistance of the photoreceptor can be improved and generation of coating defects can also be prevented when the CTL 37 is prepared by coating.

Suitable fillers having a high insulation property include fillers having a pH not less than 5 and fillers having a dielectric constant not less than 5. Specific examples thereof include titanium oxide, alumina, zinc oxide, zirconium oxide, etc. Fillers having a pH not less than 5 and fillers having a dielectric constant not less than 5 can be used alone and in combination. Further, combinations of one or more fillers having a pH not less than 5 with one or more fillers having a pH less than 5, and combinations of one or more fillers having a dielectric constant not less than 5 with one or more fillers having a dielectric constant less than 5, can also be used.

Among these fillers, α-alumina having a hexagonal closest packing structure is preferable because of having good heat stability and good abrasion resistance. By using α-alumina having a hexagonal closest packing structure, occurrence of the blurred image problem can be prevented and the abrasion resistance of the photoreceptor can be improved.

The surface of these fillers is preferably coated with a surface treatment agent to improve dispersion of the fillers. As mentioned above, when the dispersibility of the filler deteriorates, various problems occurs such that the transparency of the resultant layer decreases, coating defects are produced, and the abrasion resistance of the layer deteriorates. Therefore, a photoreceptor having good durability and capable of producing high quality images cannot be prepared.

As the surface treatment agent, known surface treating agents can be used. However, surface treatment agents, which do not deteriorate the insulation property of the filler to be treated, are preferably used.

Suitable surface treatment agents include titanate coupling agents, aluminum coupling agents, zircoaluminate coupling agents, higher fatty acids, etc. In addition, fillers treated with $Al_2O_3$, $TiO_2$, $ZrO_2$, silicones, aluminum stearate or their mixtures can also be preferably used because dispersion of the fillers can be improved and occurrence of the blurred image problem can be prevented.

When a filler treated with a silane coupling agent is used, the blurred image problem tends to occur. However, by treating a filler with a combination of one or more of the other treating agents with a silane coupling agent, there is a possibility that the blurred image problem can be avoided.

The weight ratio (ST/F) of the surface treatment agent (ST) to the filler (F) to be coated is from 3 to 30%, and preferable 5 to 20% although the preferable weight ratio changes depending on the average primary particle diameter of the filler. When the amount of the treatment agent is too small, dispersibility of the filler cannot be improved. To the contrary, when the amount of the treatment agent is too large, residual potential of the resultant photoreceptor tends to serious increase.

The average primary particle diameter of the filler included in the outermost layer is preferably from 0.01 to 0.5 μm in view of light transmittance and abrasion resistance of the resultant outermost layer. Fillers having too small an average primary particle diameter tend to have poor dispersibility and therefore the abrasion resistance of the resultant photoreceptor deteriorates. To the contrary, when the average primary particle diameter is too large, various problems tends to occur such that the filler precipitates in the coating liquid, and a film of a toner is formed on the photoreceptor.

The content of the filler in the outermost layer is preferably from 5 to 50% by weight, and more preferably from 10 to 40% by weight. When the content is too low, the abrasion resistance is hardly improved. When the content is too high, the transparency of the resultant CTL 37 deteriorates.

Then the organic compound having an acid value of from 10 to 700 mgKOH/g will be explained.

When an organic filler having an acid value of from 10 to 700 mgKOH/g is added together with a filler having a high insulation property, it is possible to prevent occurrence of residual potential increasing problem which is caused by the filler.

The acid value of an organic compound is defined as the quantity (in units of milligram) of potassium hydroxide needed for neutralizing free acids and active carboxyl groups included in 1 mg of the compound.

Specific examples of the organic compounds having an acid value of from 10 to 700 mgKOH/g include any known materials such as organic fatty acids and resins having a high acid value, which have an acid value of from 10 to 700 mgKOH/g. However, low molecular weight organic acids such as maleic acid, citric acid, tartaric acid and succinic acid, and low molecular weight acceptors tend to deteriorate the dispersibility of the filler, and thereby the residual potential decreasing effect cannot be fully produced. Therefore, in order to prevent the occurrence of the residual potential increasing problem while improving the dispersibility of the filler in the layer, polymers, resins and copolymers having a relatively low molecular weight can be preferably used. It is preferable for the compounds to have a linear structure (i.e., a structure without steric hindrance). In this case, it is important to use a compound which has good affinity for the filler and the binder resin included in the layer. Compounds having a large steric hindrance tend to have poor affinity for such fillers and binder resins, and thereby the dispersibility of the filler deteriorates, resulting in occurrence of the above-mentioned problems.

From this point of view, polycarboxylic acids are preferable as the organic compounds having such a specific acid value as mentioned above. Polycarboxylic acids are defined as compounds having two or more carboxyl group therein.

Suitable polycarboxylic acids include polymers and copolymers such as polyester resins, acrylic resins, acrylic copolymers, methacrylic copolymers, styrene/acrylic copolymers, their derivatives, etc., which have two or more carboxyl groups. These compounds can be used alone or in combination. There is a case where when these compounds are used together with a fatty acid, the dispersibility of the filler, and the residual potential decreasing effect can be improved.

In the photoreceptor of the present invention, an organic compound having an acid value of from 10 to 700 mgKOH/g is used. More preferably the acid value of the organic compound is from 30 to 400 mgKOH/g. When the acid value is too high, the resultant layer has too low an electric resistance and thereby the blurred image problem tends to occur. In contrast, when the acid value is too low, the addition content of the compound has to be increased and/or the residual potential decreasing effect cannot be effectively produced. Namely, when a compound having such a specific acid value is added, it is necessary to determine the addition amount of the compound in consideration of the acid value of the compound. In this regard, it is not necessarily true that the more acid value the added compound has, the better residual potential decreasing effect the compound produces. Specifically, the residual potential decreasing effect also depends on the ability of the filler to adsorb the compound.

The content of the organic compound having an acid value of from 10 to 700 mgKOH/g is preferably determined in consideration of the acid value thereof and the filler content. For example, when two kinds of compounds A and B having an acid value from 10 to 700 mgKOH/g are used, it is preferable that the following relationship is satisfied:

$$0.1 \leqq \text{Acid Value Equivalent}(=A \times B/C) \leqq 20$$

wherein A and B represent the acid values of the compounds A and B, respectively.

When the content of the compound having an acid value from 10 to 700 mgKOH/g is too high, there is a case where the dispersibility of the filler deteriorates and the blurred image problem occurs. In contrast, when the content is too low, the dispersibility deteriorates and the residual potential decreasing effect is insufficiently produced.

When a filler and a compound having an acid value of from 10 to 700 mgKOH/g is contained in the CTL 37, the filler and the compound are preferably dispersed in an organic solvent using a known dispersing machine such as ball mills, attritors, sand mills and supersonic dispersing machines. Among these dispersing machines, ball mills are preferable because of effectively contacting the materials to each other while foreign materials are hardly included in the liquid. As the medium for use as the balls of the ball mill, known media such as zirconia balls, alumina balls, agate balls, etc. can be used. However, in view of dispersing ability and the residual potential decreasing effect, alumina balls are preferably used. Zirconia balls tend to be abraded during the dispersion operation, and thereby the residual potential of the resultant photoreceptor seriously increases due to inclusion of the zirconia powder in the coating liquid. When zirconia powder is included in the coating liquid, the dispersibility of the filler deteriorates, and thereby the filler tends to precipitate in the liquid.

When alumina balls are used as the dispersing medium, the amount of the alumina powder caused by abrasion of the alumina balls is little. In addition, even when the alumina powder is included in the liquid, the influence thereof on the residual potential and the dispersibility of the filler is very little. Therefore, alumina balls are preferably used as the dispersing medium.

When the coating liquid is prepared, the organic compound having an acid value of from 10 to 700 mgKOH/g is preferably mixed with a filler before the dispersion process because aggregation of the filler and precipitation of the filler in the coating liquid can be prevented. The binder resin and a CTM can be mixed with the filler and the organic compound before the dispersion process. However, there is a case where the dispersibility of the filler slightly deteriorates. Therefore, it is preferable that the binder resin and the CTM are added to the dispersion including the filler and the organic compound while being dissolved in an organic solvent.

Then the compound having formula (1), which is included in the photosensitive layer and/or in the outermost layer together with the filler and the organic compound having an acid value of from 10 to 700 mgKOH/g will be explained.

The compound having formula (1) is added to solve the blurred image problem which tends to be caused by the organic compound having an acid value of from 10 to 700 mgKOH/g. Specifically, the organic compound having such an acid value tends to adsorb oxidizing materials such as ozone or NOx generated by chargers or the like used in image forming apparatus. In this case, electric resistance of the outermost layer tends to decrease, resulting in occurrence of the blurred image problem. A compound having formula (1) is added to prevent occurrence of the problem. The reason why the problem can be solved is not yet determined but it is considered to be that the substituted amino groups in the compound prevent the oxidizing materials from generating radical materials. In general, the compounds having formula (1) have a charge transportability, and therefore the compounds do not serve as charge traps. Therefore, the compounds do not increase the residual potential of the resultant photoreceptor.

The diamine compounds having formula (1) can be easily prepared by a method disclosed by E. Elceand A. S. Hay, Polymer, Vo. 37, No. 9, 1745 (1996) incorporated herein by reference. Specifically, a dihalogen compound having the following formula (2) is reacted with a secondary amine having the following formula (3) at a temperature of from room temperature to about 100° C. in the presence of a basic compound:

$$XH_2C—Ar—CH_2X \quad (2)$$

wherein Ar represents a substituted or unsubstituted aromatic hydrocarbon group; and X represents a halogen atom; and $$HN(R1)(R2) \quad (3)$$

wherein R1 and R2 independently represent a substituted or unsubstituted alkyl group or a substituted or unsubstituted aromatic hydrocarbon group, wherein at least one of R1 and R2 is a substituted or unsubstituted aromatic hydrocarbon group and R1 and R2 can optionally share bond connectivity to form a substituted or unsubstituted ring including a nitrogen atom.

Specific examples of the basic materials mentioned above include potassium carbonate, sodium carbonate, potassium hydroxide, sodium hydroxide, sodium hydride, sodium methylate, potassium-t-butoxide, etc. Specific examples of the solvent used for the reaction mentioned above include dioxane, tetrahydrofuran, toluene, xylene, dimethylsulfoxide, N,N-dimethylformamide, N-methylpyrrolidone, 1,3-dimethyl-2-imidazoline, acetonitrile, etc.

Specific examples of the alkyl groups for use in the groups R1 and R2 include a methyl group, an ethyl group, a propyl group, a butyl group, a hexyl group, an undecanyl group, etc. Specific examples of the aromatic hydrocarbon groups include aromatic ring groups such as a phenyl group, a biphenyl group, an anthryl group, a fluorenyl group, and a pyrenyl group; and aromatic heterocylic groups such as a pyridyl group, a quinolyl group, a thiophenyl group, a furanyl group, a furyl group, an oxazolyl group, an oxadiazolyl group, a carbazolyl group, etc. These groups can be substituted. Specific examples of the substituents include alkoxy groups such as a methoxy group, an ethoxy group, a propoxy group, a butoxy group; halogen atoms such as a fluorine atom, a chlorine atom, a bromine atom, and iodine atom; the above-mentioned aromatic hydrocarbon groups; and heterocylic groups such as pyrrolidinyl group, a piperidyl group and a piperazyl group. In addition, specific examples of the heterocyclic groups including a nitrogen atom, which are optionally prepared when R1 and R2 share bond connectivity, include a pyrrolidino group a piperidino group and a pieprazino group.

Specific examples of the compounds having formula (1) include the compounds listed in Tables 1 to 3. However, the compounds having formula (1) are not limited thereto.

TABLE 1

[Formula (1)]

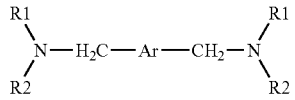

| Comp. No. | Ar | R1 | R2 |
|---|---|---|---|
| 1 | 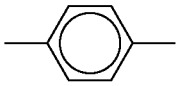 | $—CH_3$ | 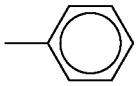 |
| 2 | 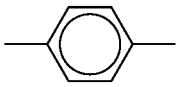 | $—CH_2CH_3$ | 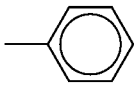 |
| 3 | 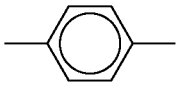 | $—CH_3$ | 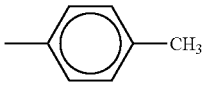 |
| 4 | 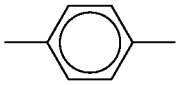 | $—CH_2CH_3$ | 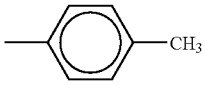 |
| 5 | 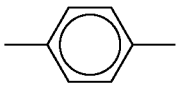 | $—CH_2CH_2CH_3$ | 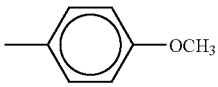 |
| 6 | 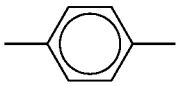 | $—CH_2CH_3$ | 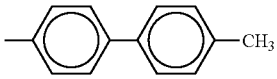 |
| 7 | 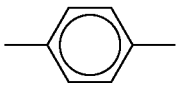 | 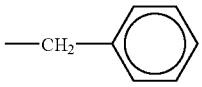 | 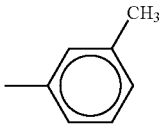 |
| 8 | 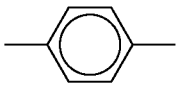 | 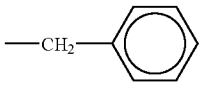 | 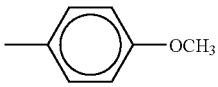 |
| 9 | 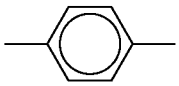 | $—CH_2CH_3$ | 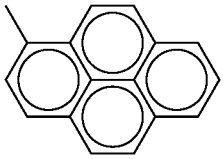 |

TABLE 1-continued
[Formula (1)]
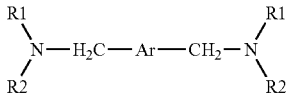
| Comp. No. | Ar | R1 | R2 |
|---|---|---|---|
| 10 | 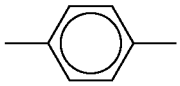 | 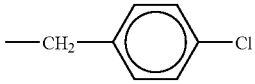 | 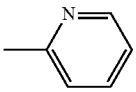 |
| 11 | 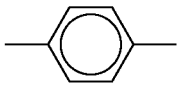 | —$CH_2CH_3$ | 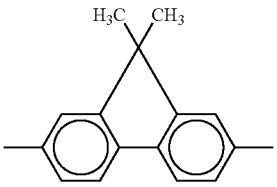 |
| 12 | 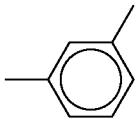 | —$CH_2CH_3$ | 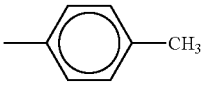 |
| 13 | 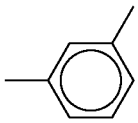 | 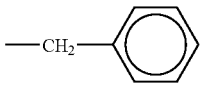 | 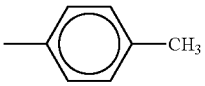 |
| 14 | 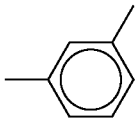 | 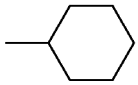 | 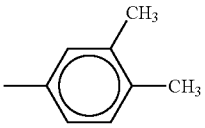 |
TABLE 2
| Comp. No. | Ar | R1 | R2 |
|---|---|---|---|
| 15 | 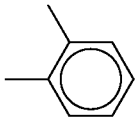 | —$CH_2CH_3$ | 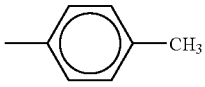 |
| 16 | 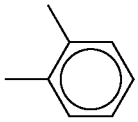 | —$CH_3$ | 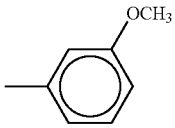 |
| 17 | 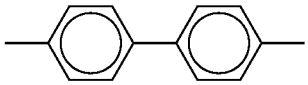 | —$CH_2CH_3$ | 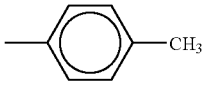 |
| 18 | 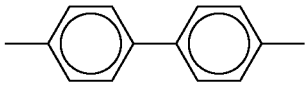 | 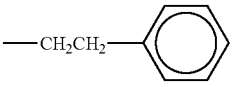 | 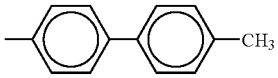 |

TABLE 2-continued
| Comp. No. | Ar | R1 | R2 |
|---|---|---|---|
| 19 | 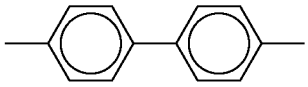 | $—CH_3$ | 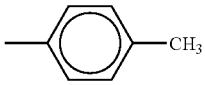 |
| 20 | 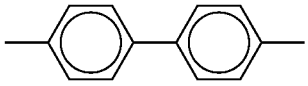 | $—CH_2CH_3$ | 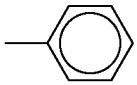 |
| 21 | 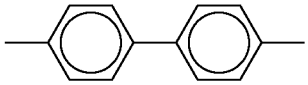 | 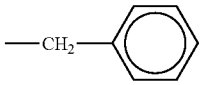 | 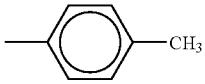 |
| 22 | 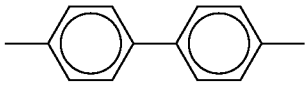 | 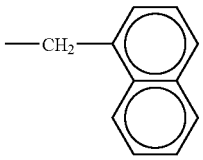 | 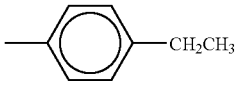 |
| 23 | 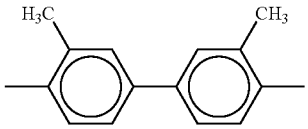 | $—CH_2CH_3$ | 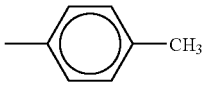 |
| 24 | 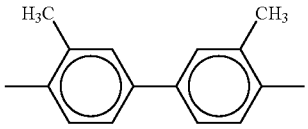 | 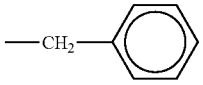 | 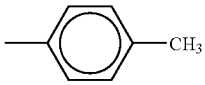 |
| 25 | 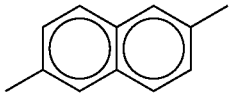 | $—CH_2CH_3$ | 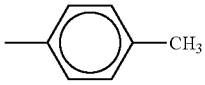 |
| 26 | 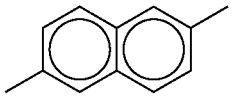 | $—CH_3$ | 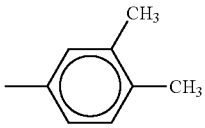 |
| 27 | 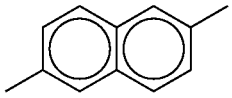 | 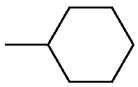 | 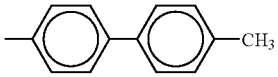 |
| 28 | 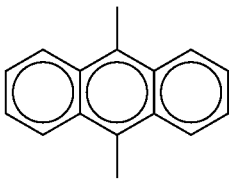 | $—CH_2CH_3$ | 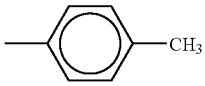 |

TABLE 3

| Comp. No. | Ar | R1 | R2 |
|---|---|---|---|
| 29 | 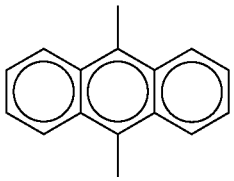 | $-CH_3$ | 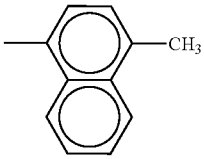 |
| 30 | 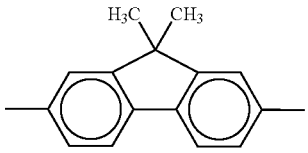 | $-CH_2CH_3$ | 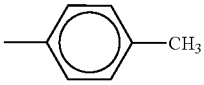 |
| 31 | 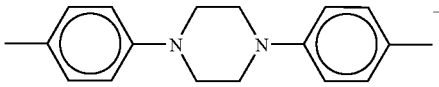 | $-CH_2CH_3$ | 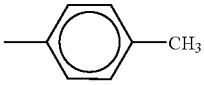 |
| 32 | 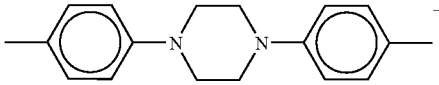 | $-CH_2CH_3$ | 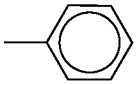 |
| 33 | 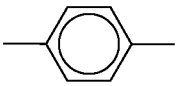 | $-CH_2CH_3$ | 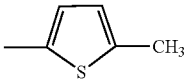 |
| 34 | 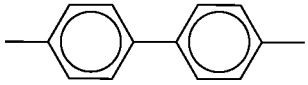 | $-CH_2CHCH_3$ (CH3) | 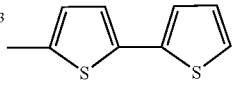 |
| 35 | 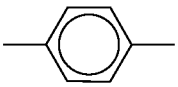 | | 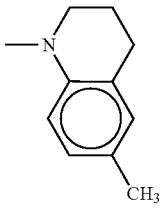 |
| 36 | 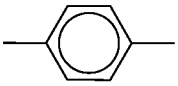 | | 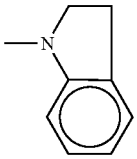 |
| 37 | 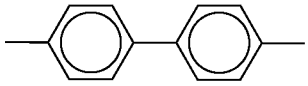 | | 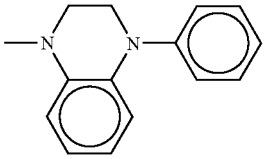 |

The content of the compound having formula (1) in the layer is preferably from 0.01 to 150% by weight based on the weight of the binder resin included in the layer. When the content is too low, the resistance to oxidizing materials of the resultant layer is poor. In contrast, when the content is too high, the film strength of the resultant layer deteriorates, resulting in deterioration of the abrasion resistance of the layer.

When a coating liquid including a compound having formula (1) and a compound having an acid value of from 10 to 700 mgKOH/g is preserved, an antioxidant is preferably added to the coating liquid to prevent formation of salts of the compounds. When the salts are formed, not only the coating liquid is colored, but also the resultant photoreceptor causes the residual potential increasing problem. The coloring of the coating liquid, which is caused by formation of salts of the compounds, is mainly due to the specific structure of the compound having formula (1). The present inventors discover that by including one or more of the below-mentioned specific antioxidants in the coating liquid, the preservation property of the coating liquid can be improved.

As the antioxidant, known antioxidants can be used, but hydroquinone-based antioxidants and hindered amine-based antioxidants are effective.

The object of using an antioxidant in the coating liquid is different from that of using the antioxidants mentioned below for use in the layers constituting the photoreceptor, and is to protect the compound having formula (1) in the coating liquid. Therefore, in this case the antioxidant is preferably added to the coating liquid before the compound having formula (1) is added to the coating liquid. The content of the antioxidant is preferably 0.1 to 200% by weight based on the compound having an acid value of from 10 to 700 mgKOH/g to impart good preservability to the resultant coating liquid.

The CTL 37 preferably includes a charge transport polymer, which has both a binder resin function and a charge transport function, because the resultant CTL has good abrasion resistance and the resultant photoreceptor can produce high quality image. Known charge transport materials can be used for the CTL 37. In particular, polycarbonate resins having a triarylamine group in their main chain and/or side chain are preferably used. In particular, charge transport polymers having the following formulae of from (4) to (13) are preferably used:

(4)

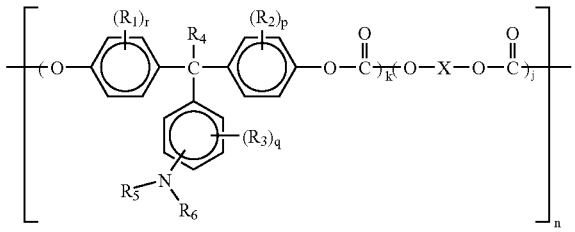

wherein $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aromatic hydrocarbon group; r, p and q independently represent 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula (14):

(14)

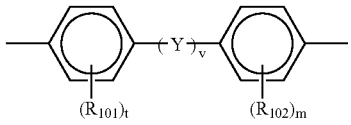

wherein $R_{101}$ and $R_{102}$ independently represent a substituted or unsubstituted alkyl group, a substituted or unsubstituted aromatic hydrocarbon group, or a halogen atom; t and m represent 0 or an integer of from 1 to 4; v is 0 or 1; and Y represents a linear alkylene group, a branched alkylene group, a cyclic alkylene group, —O—, —S—, —SO—, —$SO_2$—, —CO—, —CO—O-Z-O—CO— (Z represents a divalent aliphatic group), or a group having the following formula (15):

(15)

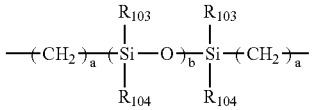

wherein a is an integer of from 1 to 20; b is an integer of from 1 to 2000; and $R_{103}$ and $R_{104}$ independently represent a substituted or unsubstituted alkyl group, or a substituted or unsubstituted aromatic hydrocarbon group, wherein each of $R_{101}$, $R_{102}$, $R_{103}$ and $R_{104}$ may be the same or different from the others.

(5)

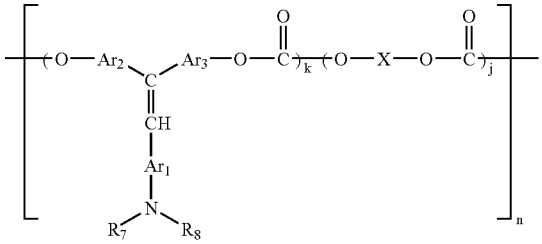

wherein $R_7$ and $R_8$ independently represent a substituted or unsubstituted aromatic hydrocarbon group; $Ar_1$, $Ar_2$ and $Ar_3$ independently represent an arylene group; and X, k, j and n are defined above in formula (4).

(6)

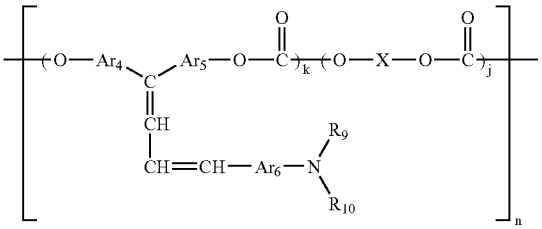

wherein $R_9$ and $R_{10}$ independently represent a substituted or unsubstituted aromatic hydrocarbon group; $Ar_4$, $Ar_5$ and $Ar_6$ independently represent an arylene group; and X, k, j and n are defined above in formula (4).

(7)

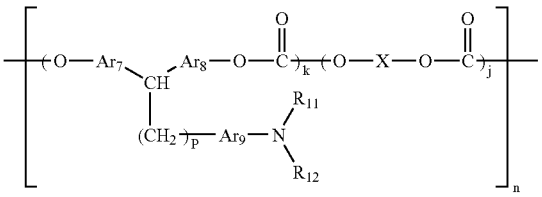

wherein $R_{11}$ and $R_{12}$ independently represent a substituted or unsubstituted aromatic hydrocarbon group; $Ar_7$, $Ar_8$ and $Ar_9$ independently represent an arylene group; p is an integer of from 1 to 5; and X, k, j and n are defined above in formula (4).

(8)

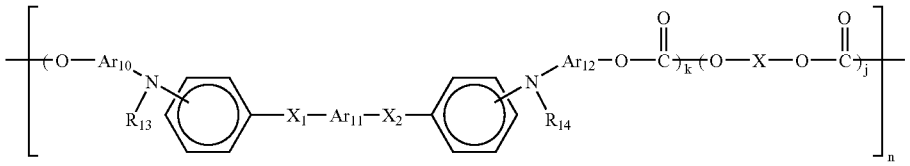

wherein $R_{13}$ and $R_{14}$ independently represent a substituted or unsubstituted aromatic hydrocarbon group; $Ar_{10}$, $Ar_{11}$ and $Ar_{12}$ independently represent an arylene group; $X_1$ and $X_2$ independently represent a substituted or unsubstituted ethylene group, or a substituted or unsubstituted vinylene group; and X, k, j and n are defined above in formula (4).

(9)

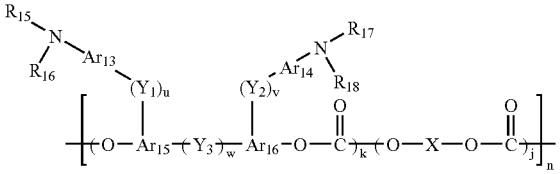

wherein $R_{15}$, $R_{16}$, $R_{17}$ and $R_{18}$ independently represent a substituted or unsubstituted aromatic hydrocarbon group; $Ar_{13}$, $Ar_{14}$, $Ar_{15}$ and $Ar_{16}$ independently represent an arylene group; $Y_1$, $Y_2$ and $Y_3$ independently represent a substituted or unsubstituted alkylene group, a substituted or unsubstituted cycloalkylene group, a substituted or unsubstituted alkylene ether group, an oxygen atom, a sulfur atom, or a vinylene group; u, v and w independently represent 0 or 1; and X, k, j and n are defined above in formula (4).

(10)

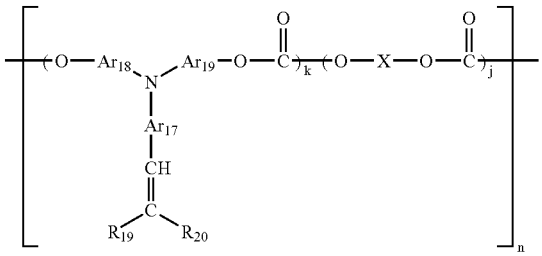

wherein $R_{19}$ and $R_{20}$ independently represent a hydrogen atom, or substituted or unsubstituted aromatic hydrocarbon group, and $R_{19}$ and $R_{20}$ optionally share bond connectivity to form a ring; $Ar_{17}$, $Ar_{18}$ and $Ar_{19}$ independently represent an arylene group; and X, k, j and n are defined above in formula (4).

(11)

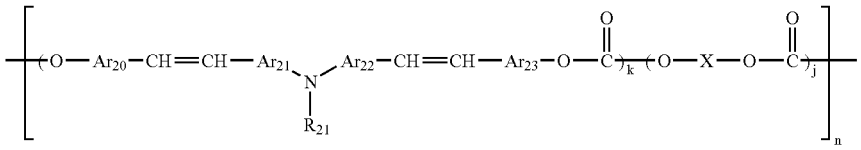

wherein $R_{21}$ represents a substituted or unsubstituted aromatic hydrocarbon group; $Ar_{20}$, $Ar_{21}$, $Ar_{22}$ and $Ar_{23}$ independently represent an arylene group; and X, k, j and n are defined above in formula (4).

(12)

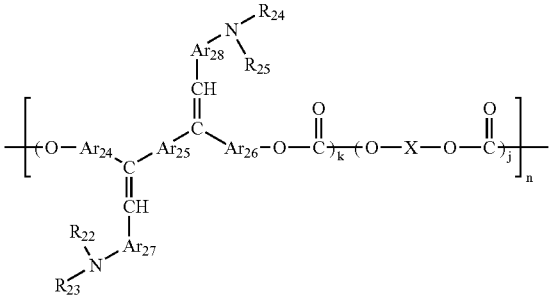

wherein $R_{22}$, $R_{23}$, $R_{24}$ and $R_{25}$ independently represent a substituted or unsubstituted aromatic hydrocarbon group; $Ar_{24}$, $Ar_{25}$, $Ar_{26}$, $Ar_{27}$ and $Ar_{28}$ independently represent an arylene group; and X, k, j and n are defined above in formula (4).

(13)

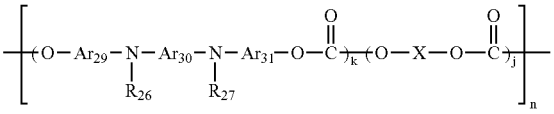

wherein $R_{26}$ and $R_{27}$ independently represent a substituted or unsubstituted aromatic hydrocarbon group; $Ar_{29}$, $Ar_{30}$ and $Ar_{31}$ independently represent an arylene group; and X, k, j and n are defined above in formula (4).

In addition, polymers having the following formula can also be used as the charge transport polymer material.

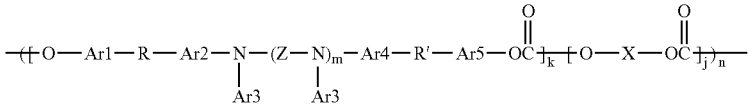

wherein Ar1, Ar2, Ar3, Ar4 and Ar5 independently represent a substituted or unsubstituted aromatic hydrocarbon group; Z represents an aromatic hydrocarbon group or a group —Ar6-Za-Ar6-, wherein Ar6 represents a substituted or unsubstituted aromatic hydrocarbon group, Za represents O, S or an alkylene group; R and R' independently represent a linear or branched alkylene group; m is 0 or 1; and X, k, j and n are defined above in formula (4).

The CTL layer is typically formed by coating a CTL coating liquid by a known coating method such as dip coating methods, spray coating methods, bead coating methods, nozzle coating methods, spinner coating methods and ring coating methods. When a filler is included in an outermost layer, the filler can be included in the layer such that the concentration is uniform at any portion of the layer. However, the concentration of the filler is preferably changed by gradation such that the concentration in the surface portion of the layer is higher than that in the bottom portion of the layer. Alternatively, it is possible that the outermost layer includes plural layers and the concentration of the filler in a layer is changed such that the upper layer has a higher filler concentration.

Next, the single-layered photosensitive layer 33 (as illustrated in FIGS. 1 and 3) will be explained. The photosensitive layer 33 can be formed by coating a coating liquid in which a CGM, a CTL and a binder resin are dissolved or dispersed in a proper solvent, and then drying the coated liquid. The photosensitive layer 33 preferably includes a compound having formula (1). As the CGM and CTM, the CGMs and CTLs mentioned above for use in the CGL 35 and CTL 37 can be used. If desired, additives such as plasticizers, leveling agents and antioxidants can be included in the layer.

Suitable binder resins for use in the single-layered photosensitive layer 33 include the resins mentioned above for use in the CTL 37. In addition, the resins mentioned above for use in the CGL 35 can be used in combination with the binder resins for use in the CTL 37. In addition, the charge transport polymer materials for use in the CTL 37 can be preferably used as a binder resin.

The content of the CGM is preferably from 5 to 40 parts by weight per 100 parts by weight of the binder resin included in the single-layered photosensitive layer 33. The content of the CTM is preferably from 0 to 190 parts, and more preferably from 50 to 150 parts by weight, per 100 parts by weight of the binder resin included in the single-layered photosensitive layer 33.

The single-layered photosensitive layer 33 can be formed by coating a coating liquid in which a CGM, a binder and a CTM are dissolved or dispersed in a solvent such as tetrahydrofuran, dioxane, dichloroethane and cyclohexane by a coating method such as dip coating, spray coating, bead coating and ring coating.

The thickness of the photosensitive layer 33 is preferably from about 5 to about 25 μm.

When the single-layered photosensitive layer 33 is the outermost layer, the photosensitive layer 33 further includes a filler, an organic compound having an acid value of from 10 to 700 mgKOH/g, and a compound having formula (1).

In this case, the filler concentration can also be changed by gradation in the single-layered photosensitive layer 33 as mentioned above.

In the photoreceptor of the present invention, an undercoat layer may be formed between the substrate 31 and the photosensitive layer (i.e., the photosensitive layer 33 in FIGS. 1 and 3, the CGL 35 in FIGS. 2 and 4, and the CTL in FIG. 5).

The undercoat layer typically includes a resin as a main component. Since a photosensitive layer is typically formed on the undercoat layer by coating a liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer may include a fine powder of metal oxides such as titanium oxide, silica, alumina, zirconium oxide, tin oxide and indium oxide to prevent occurrence of moiré in the resultant images and to decrease residual potential of the resultant photoreceptor.

The undercoat layer can also be formed by coating a coating liquid using a proper solvent and a proper coating method mentioned above for use in the photosensitive layer.

The undercoat layer may be formed using a silane coupling agent, titanium coupling agent or a chromium coupling agent.

In addition, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method is also preferably used as the undercoat layer.

The thickness of the undercoat layer is preferably 0 to 5 μm.

In the photoreceptor of the present invention, the protective layer 39 is preferably formed as an outermost layer as illustrated in FIGS. 3-5 to protect the photosensitive layer.

Specific examples of the binder resin for use in the protective layer 39 include ABS resins, ACS resins, olefin-vinyl monomer copolymers, chlorinated polyether, aryl resins, phenolic resins, polyacetal, polyamide, polyamideimide, polyacrylate, polyallysulfone, polybutylene, polybutylene terephthalate, polycarbonate, polyethersulfone, polyethylene, polyethylene terephthalate, polyimide, acrylic resins, polymethylpentene, polypropylene, polyphenyleneoxide, polysulfone, polystyrene, polyarylate, AS resins, butadiene-styrene copolymers, polyurethane, polyvinyl chloride, polyvinylidene chloride, epoxy resins, etc. Among these resins, polycarbonate resins and polyarylate are preferably used because the resins have good filler dispersing ability, good residual potential decreasing ability and good coating defects and the resins hardly cause coating defects.

When the photoreceptor has such a structure as illustrated in FIGS. 4 and 5, the materials and constitution of the CGL 35 and CTL 37 are the same as those of the CGL 35 and CTL 37 of the photoreceptor illustrated in FIG. 2. In addition, when the photoreceptor has such a structure as illustrated in FIG. 3, the materials and constitution of the single-layered photosensitive layer 33 are the same as those of the photosensitive layer 33 of the photoreceptor illustrated in FIG. 1.

The protective layer 39 includes a filler to improve the abrasion resistance of the photoreceptor. In addition, the protective layer further includes an organic compound having an acid value of from 10 to 700 mgKOH/g and a compound having formula (1).

Specific examples of the filler for use in the protective layer include the fillers mentioned above for use in the CTL 37. Among the fillers, inorganic fillers are preferably used in view of abrasion resistance. In particular, metal oxides having a pH not less than 5 and/or a dielectric constant not less than 5 are more preferably used because of having good blurred image preventing ability. Specific examples of the metal oxides include titanium oxide, alumina, zinc oxide, zirconium oxide, etc. As mentioned above, these fillers can be used alone or in combination. In addition, combinations of a filler having a pH less than 5 and a filler having a pH not less than 5, or combinations of a filler having a dielectric constant less than 5 and a filler having a dielectric constant not less than 5, can also be used. Among these fillers, α-alumina is even more preferably used because α-alumina has high insulating property, good heat stability and high hardness (i.e., good abrasion resistance), and hardly cause agglomeration.

The surface of the filler used for the protective layer is preferably coated with a surface treatment agent to improve dispersibility of the filler. The surface treatment agents mentioned above for use in the CTL 37 can also be used for the protective layer 39. The surface treatment agents can be used alone or in combination.

The weight ratio (ST/F) of the surface treatment agent (ST) to the filler (F) to be coated is from 3 to 30%, and preferable 5 to 20% although the preferable weight ratio changes depending on the average primary particle diameter of the filler. When the amount of the treatment agent is too small, dispersibility of the filler cannot be improved. To the contrary, when the amount of the treatment agent is too large, residual potential of the resultant photoreceptor tends to serious increase.

The average primary particle diameter of the filler included in the outermost layer is preferably from 0.01 to 0.5 μm in view of light transmittance and abrasion resistance of the protective layer. Fillers having too small an average primary particle diameter tend to have poor dispersibility and therefore the abrasion resistance of the resultant photoreceptor deteriorates. In contrast, when the average primary particle diameter is too large, various problems occurs such that the filler tends to precipitate in the coating liquid, and a film of a toner tends to be formed on the photoreceptor.

The content of the filler in the protective layer is preferably from 0.1 to 50% by weight, and more preferably from 5 to 30% by weight. When the content is too low, good abrasion resistance cannot be imparted to the protective layer. When the content is too high, the transparency of the resultant protective layer 39 deteriorates.

The organic compounds having an acid value of from 10 to 700 mgKOH/g mentioned above for use in the CTL 37 can also be used for the protective layer 39. Similarly to the case of the CTL 37, polycarboxylic acids are preferably used for the protective layer.

Polycarboxylic acids are defined as compounds having two or more carboxyl group therein. Suitable polycarboxylic acids for use in the protective layer include polymers such as polyester resins, acrylic resins, acrylic copolymers, methacrylic copolymers, styrene/acrylic copolymers, their derivatives, etc., which have a plurality of carboxyl groups therein. These compounds can be used alone or in combination. There is a case where when these compounds are used in combination, the dispersibility of the filler can be improved.

It is preferable that the acid value of the organic compound included in the protective layer is from 30 to 400 mgKOH/g. When the acid value is too high, the resultant images tend to be blurred because the resistance of the protective layer decreases. In contrast, when the acid value is too low, the addition content of the compound has to be increased and/or the residual potential decreasing effect cannot be effectively produced. Namely, when a compound having such a specific acid value is added, it is necessary to determine the addition amount of the compound in consideration of the acid value of the compound. In this regard, it is not necessarily true that the more acid value the added compound has, the better residual potential decreasing effect the compound can produce. Specifically, the residual potential decreasing effect also depends on the ability of the filler to adsorb the compound.

The content of the organic compound having an acid value of from 10 to 700 mgKOH/g is preferably determined in consideration of the acid value thereof and the filler content. For example, when two kinds of compounds A and B having an acid value from 10 to 700 mgKOH/g are used, it is preferable that the following relationship is satisfied:

$$0.1 \leqq (A \times B/C) \leqq 20$$

wherein A and B represent the acid values of the compounds A and B, respectively When the content of the compound having an acid value from 10 to 700 mgKOH/g is too high, there is a case where the dispersibility of the filler deteriorates and the blurred image problem occurs. In contrast, when the content is too low, the dispersibility deteriorates and the residual potential decreasing effect is insufficiently produced.

As the compound having formula (1) used for improving the oxidizing-gas resistance of the protective layer, the compounds mentioned above for use in the CTL 37 serving as an outermost layer can also be used.

Suitable organic solvents for use in the protective layer coating liquid include tetrahydrofuran, dioxane, toluene, dichloromethane, monochlorobenzene, dichloroethane, cyclohexanone, methyl ethyl ketone, acetone, etc. A solvent having high viscosity is preferable when a coating liquid is prepared, but a volatile solvent is preferable in view of drying of the coating liquid. Therefore it is preferable to select a solvent fulfilling such requirements. It is preferable to use a mixture solvent if there is no solvent fulfilling such requirements. This method is useful for improving dispersion stability of the filler used and for preventing occurrence of the residual potential increasing problem.

In addition, the protective layer 39 preferably includes a CTM or a charge transport polymer material to decrease the residual potential and improve the image qualities.

The protective layer is typically formed by the following method. At least a filler, an organic compound having an acid value of from 10 to 700 mgKOH/g, and a compound having formula (1) are dispersed in an organic solvent using a dispersing machine such as ball mills, attritors, sand mills and supersonic dispersing machines. Among these dispersing machines, ball mills are preferable because of effectively contacting the materials to each other while foreign materials are hardly included in the liquid.

Suitable dispersing media for use as the balls of the ball mills include known media such as zirconia, alumina, agate, glass, etc. Among these media, alumina is preferable in view of dispersion efficiency and residual potential decreasing effect. When zirconia is used as a dispersing element, zirconia is abraded during the dispersion process, resulting in contamination of zirconia in the coating liquid, and thereby residual potential of the resultant photoreceptor tends to increase and the filler tends to easily precipitate in the resultant coating liquid.

When alumina is used as a dispersing medium, the abrasion amount of alumina is much less than zirconia, and therefore the influence on residual potential is very little. Therefore alumina is preferable as the dispersing medium. In addition, it is preferable to use alumina as a filler when alumina balls are used as the dispersing medium.

When the protective layer coating liquid is prepared, the organic compound having such a specific acid value is preferably mixed with a filler and an organic solvent before the dispersion process. In this case, agglomeration and precipitation of the filler in the coating liquid can be prevented and the dispersibility of the filler can be dramatically improved. A binder resin, and a CTM can be mixed with the materials before the dispersion process, but there is a case where the dispersibility of the filler slightly deteriorates. Therefore, it is preferable to add a binder resin and a CTM, which are dissolved in an organic solvent.

When the protective layer is formed, a known coating method such as dip coating methods, spray coating methods, bead coating methods, nozzle coating methods and ring coating methods can be used. In particular, spray coating methods are preferably used to prepare a uniform film. The protective layer can be formed by performing coating once or more times. However, it is preferable to perform coating twice or more times (i.e., to form a multi-layered protective layer), because the filler is uniformly dispersed in the resultant layer without agglomerating. By forming the protective layer by this method, the resultant photoreceptor has good abrasion resistance and can produce images having good resolution without causing the residual potential increasing problem.

The thickness of the protective layer is preferably from 0.1 to 10 μm. By including an organic compound having an acid value of from 10 to 700 mgKOH/g therein, the residual potential can be dramatically decreased, and thereby the flexibility in designing the thickness of the protective layer can be improved. However, the protective layer is too thick, the image qualities slightly deteriorates, and therefore it is not preferable.

In the photoreceptor of the present invention, an intermediate layer can be formed between the protective layer and the photosensitive layer (i.e., between the protective layer 39 and the single-layered photosensitive layer 33 in FIG. 3, the CTL 37 in FIG. 4 or the CGL 35 in FIG. 5). The intermediate layer includes a binder resin as a main component. Specific examples of the resins include polyamide resins, alcohol-soluble nylon, water-soluble polyvinyl butyral, polyvinyl butyral, polyvinyl alcohol, etc. The intermediate layer can be formed by such a known coating method as mentioned above. The thickness of the intermediate layer is from 0.05 to 2 μm.

In the photoreceptor of the present invention, one or more additives such as antioxidants, plasticizers, lubricants, ultraviolet absorbents, low molecular weight charge transport materials and leveling agents can be used in one or more layers of the CGL, CTL, undercoat layer, protective layer and intermediate layers to improve the stability to withstand environmental conditions, namely to avoid decrease of photosensitivity and increase of residual potential.

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-containing Compounds dilauryl-3,3'-thiodipropionate, distearyl-3,3'-thiodipropionate, ditetradecyl-3,3'-thiodipropionate, and the like.

(e) Organic Phosphorus-containing Compounds triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters trioctyl trimellitate, tri-n-octyl trimellitate, octyl oxybenzoate, and the like.

(d) Dibasic Fatty Acid Esters dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives butyl oleate, glycerin monooleate, methyl acetylricinolate, pentaerythritol esters, dipentaerythritol hexaesters, triacetin, tributyrin, and the like.

(f) Oxyacid Esters methyl acetylricinolate, butyl acetylricinolate, butylphthalylbutyl glycolate, tributyl acetylcitrate, and the like.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters diethylene glycol dibenzoate, triethylene glycol di-2-ethylbutyrate, and the like.

(i) Chlorine-containing Compounds chlorinated paraffin, chlorinated diphenyl, methyl esters of chlorinated fatty acids, methyl esters of methoxychlorinated fatty acids, and the like.

(j) Polyester Compounds polypropylene adipate, polypropylene sebacate, acetylated polyesters, and the like.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbons liquid paraffins, paraffin waxes, micro waxes, low molecular weight polyethylenes, and the like.

(b) Fatty Acids lauric acid, myristic acid, palmitic acid, stearic acid, arachidic acid, behenic acid, and the like.

(c) Fatty Acid Amides

Stearic acid amide, palmitic acid amide, oleic acid amide, methylenebisstearamide, ethylenebisstearamide, and the like.

(d) Ester Compounds lower alcohol esters of fatty acids, polyhydric alcohol esters of fatty acids, polyglycol esters of fatty acids, and the like.

(e) Alcohols cetyl alcohol, stearyl alcohol, ethylene glycol, polyethylene glycol, polyglycerol, and the like.

(f) Metallic Soaps lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds silicone compounds, fluorine compounds, and the like.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds ethyl-2-cyano-3,3-diphenyl acrylate, methyl-2-carbomethoxy-3-(paramethoxy) acrylate, and the like.

(e) Quenchers (Metal Complexes)

nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Hereinafter electrophotographic image forming method and apparatus will be explained as embodiments of the image forming method and image forming apparatus of the present invention referring to drawings. However, the image forming method and image forming apparatus of the present invention are not limited thereto.

Figure 6:
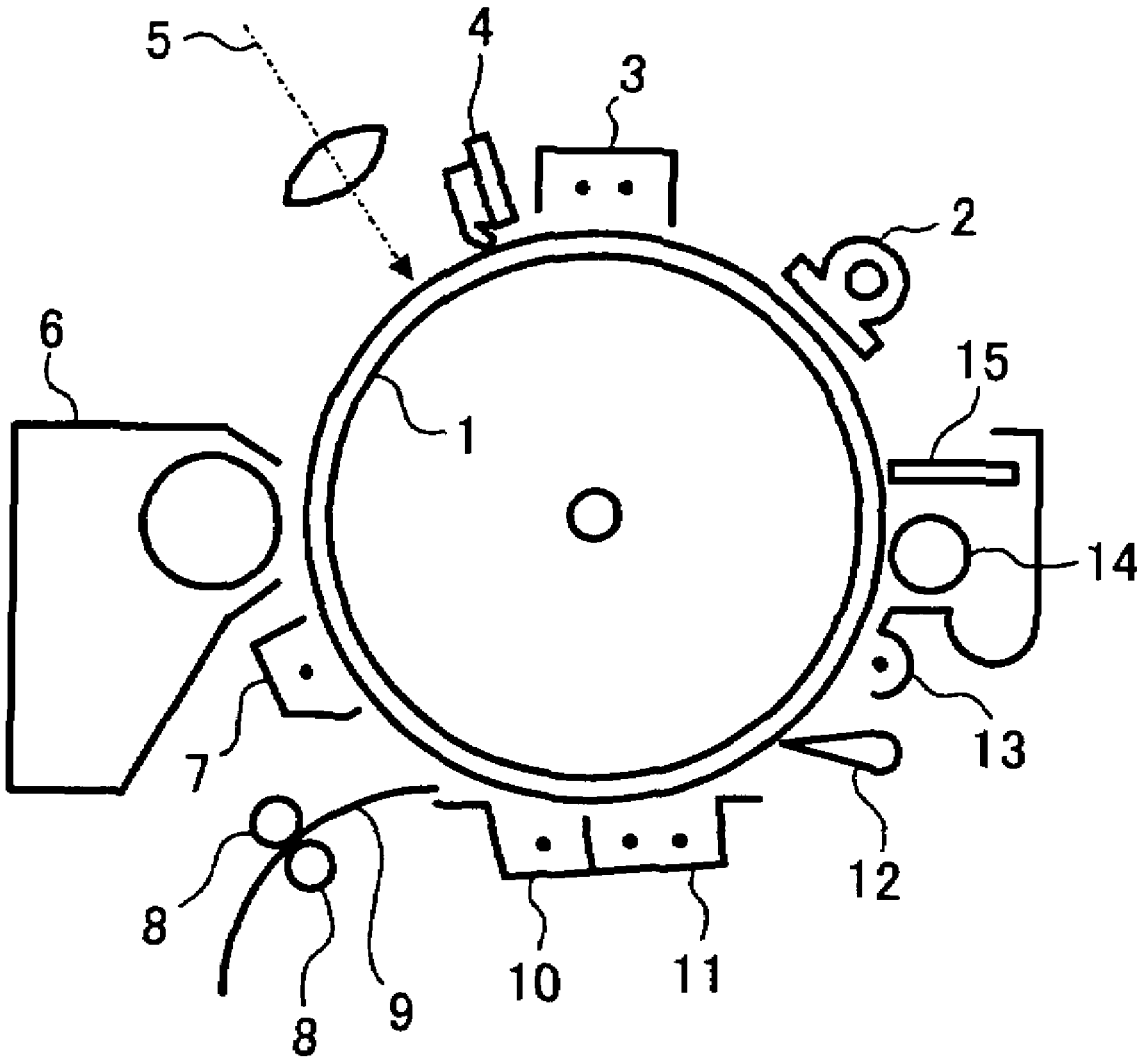
FIG. 6 is a schematic view illustrating an embodiment of the image forming apparatus of the present invention and for explaining the image forming method of the present invention.

FIG. 6 is a schematic view for explaining electrophotographic image forming method and apparatus according to an embodiment of the present invention.

In FIG. 6, numeral 1 denotes a photoreceptor. The photoreceptor 1 is the photoreceptor of the present invention which includes at least a photosensitive layer located overlying an electroconductive substrate, wherein the photoreceptor is the photoreceptor of the present invention. The photoreceptor 1 has a drum form, but sheet-form and endless belt-form photoreceptors can also be used.

Around the photoreceptor 1, a discharging lamp 2, a charger 3 configured to charge the photoreceptor 1, an imagewise light irradiator 5 configured to irradiate the photoreceptor 1 with imagewise light to form an electrostatic latent image on the photoreceptor 1, an image developer 6 configured to develop the latent image with a toner to form a toner image on the photoreceptor 1, a cleaning unit including a cleaning brush 14 and a cleaning blade 15 configured to clean the surface of the photoreceptor 1 are arranged while contacting or being set closely to the photoreceptor 1. The toner image formed on the photoreceptor 1 is transferred on a receiving paper 9 fed by a pair of registration rollers 8 at the transfer device (i.e., a pair of a transfer charger 10 and a separating charger 11). The receiving paper 9 having the toner image thereon is separated from the photoreceptor 1 by a separating pick 12.

In the image forming apparatus of the present invention, a pre-transfer charger 7 and a pre-cleaning charger 13 may be arranged if desired.

As the charger 3, the pre-transfer charger 7, the transfer charger 10, the separating charger 11 and the pre-cleaning charger 13, all known chargers such as corotrons, scorotrons, solid state chargers, roller chargers and brush chargers can be used.

As the transfer device, the above-mentioned chargers can be used. Among the chargers, a combination of the transfer charger 10 and the separating charger 11 as shown in FIG. 6 is preferably used.

Suitable light sources for use in the imagewise light irradiator 5 and the discharging lamp 2 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

The above-mentioned lamps can be used for not only the processes mentioned above and illustrated in FIG. 6, but also other processes using light irradiation, such as a transfer process including light irradiation, a discharging process, a cleaning process including light irradiation and a pre-exposure process.

When the toner image formed on the photoreceptor 1 by the developing unit 6 is transferred onto the receiving paper 9, all of the toner image are not transferred on the receiving paper 9, and residual toner particles remain on the surface of the photoreceptor 1. The residual toner is removed from the photoreceptor 1 by the fur blush 14 or the cleaning blade 15. The residual toner remaining on the photoreceptor 1 can be removed by only a cleaning brush. Suitable cleaning blushes include known cleaning blushes such as fur blushes and mag-fur blushes.

When the photoreceptor 1 which is previously charged positively (or negatively) is exposed to imagewise light, an electrostatic latent image having a positive or negative charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained. As the developing method, known developing methods can be used. In addition, as the discharging methods, known discharging methods can also be used.

Figure 7:
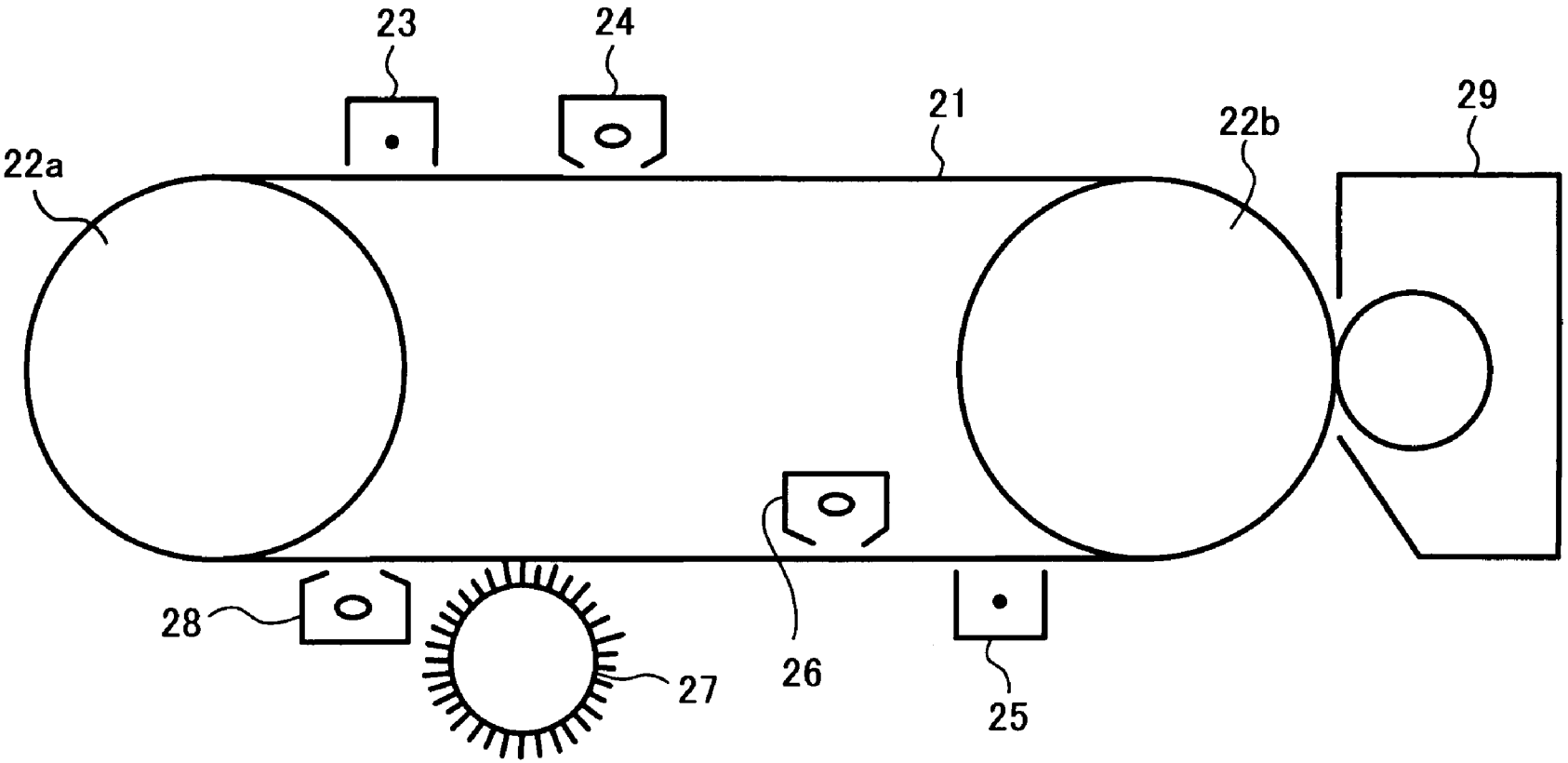
FIG. 7 is a schematic view illustrating another embodiment of the image forming apparatus of the present invention and for explaining the image forming method of the present invention.

FIG. 7 is a schematic view illustrating another embodiment of the electrophotographic image forming apparatus according to the present invention. In this embodiment, a belt-shaped photoreceptor 21 is used. The photoreceptor 21 is the photoreceptor of the present invention.

The belt-shaped photoreceptor 21 is rotated by rollers 22*a* and 22*b*. The photoreceptor 21 is charged with a charger 23, and then exposed to imagewise light emitted by an imagewise light irradiator 24 to form an electrostatic latent image on the photoreceptor 21. The latent image is developed with a developing unit 29 to form a toner image on the photoreceptor 21. The toner image is transferred onto a receiving paper (not shown) using a transfer charger 25. After the toner image transferring process, the surface of the photoreceptor 21 is cleaned with a cleaning brush 27 after performing a pre-cleaning light irradiating operation using a pre-cleaning light irradiator 26. Then the photoreceptor 21 is discharged by being exposed to light emitted by a discharging light source 28. In the pre-cleaning light irradiating process, light irradiates the photoreceptor 21 from the side of the substrate thereof. In this case, the substrate has to be light-transmissive.

The image forming apparatus of the present invention is not limited to the image forming units as shown in FIGS. 6 and 7. For example, in FIG. 7, the pre-cleaning light irradiating operation can be performed from the photosensitive layer side of the photoreceptor 21. In addition, the light irradiation in the light image irradiating process and the discharging process may be performed from the substrate side of the photoreceptor 21.

Further, a pre-transfer light irradiation operation, which is performed before the transferring of the toner image, and a preliminary light irradiation operation, which is performed before the imagewise light irradiation, and other light irradiation operations may also be performed.

The above-mentioned image forming unit may be fixedly set in a copier, a facsimile or a printer. However, the image forming unit may be set therein as a process cartridge. The process cartridge means an image forming unit which includes a photoreceptor and at least one or more of a charger, an imagewise light irradiator, an image developer, an image transfer device, a cleaner, and a discharger.

Figure 8:
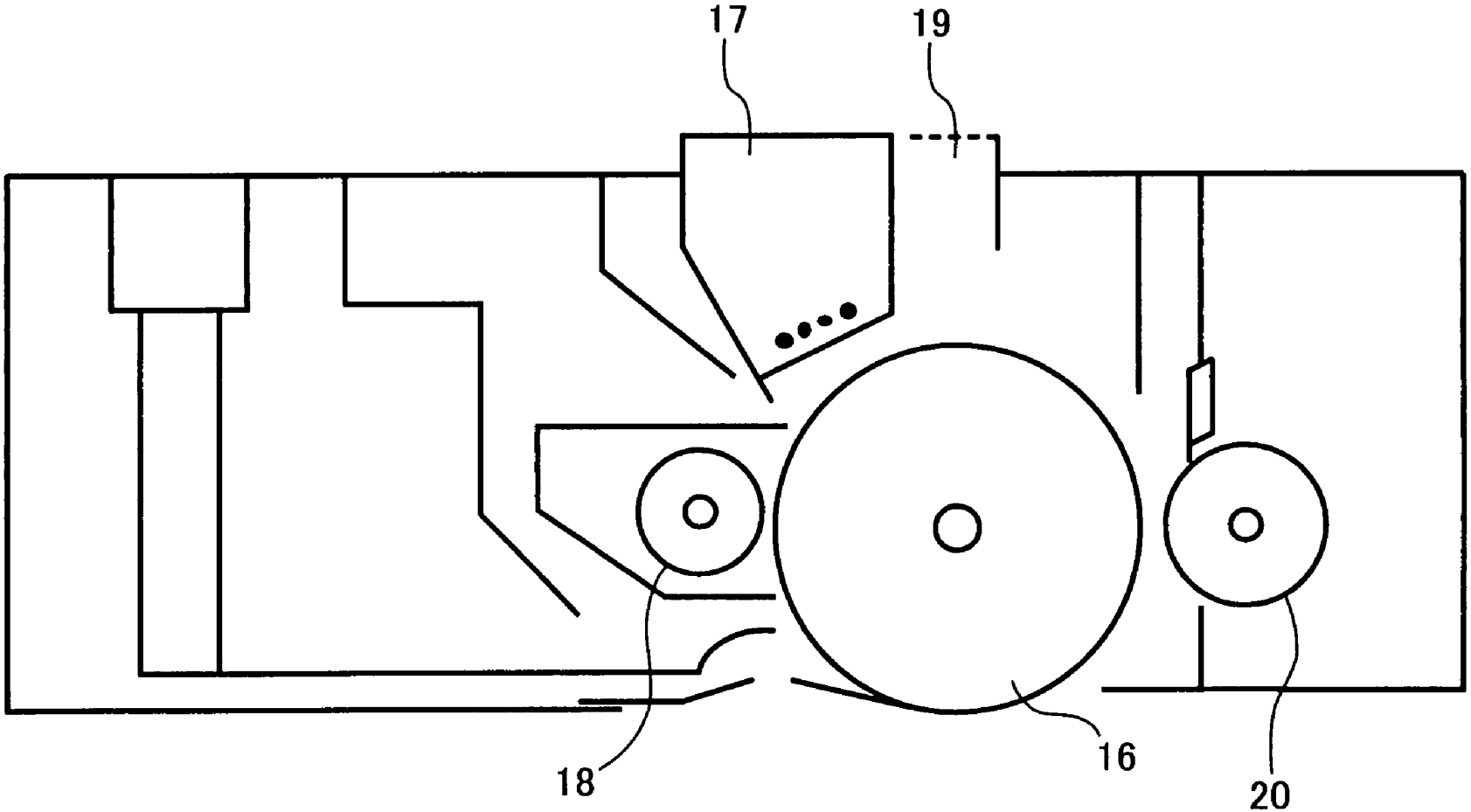
FIG. 8 is a schematic view illustrating an embodiment of the process cartridge of the present invention.

FIG. 8 is a schematic view illustrating an embodiment of the process cartridge of the present invention. In FIG. 8, the process cartridge includes a photoreceptor 16, a charger 17 configured to charge the photoreceptor 16, a cleaning brush 18 configured to clean the surface of the photoreceptor 16, an imagewise light irradiator 19 configured to irradiate the photoreceptor 16 with imagewise light to form an electrostatic latent image on the photoreceptor 16, and an image developer (a developing roller) 20 configured to develop the latent image with a toner. The photoreceptor 16 is the photoreceptor of the present invention. The process cartridge of the present invention is not limited thereto.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Each of the following undercoat layer coating liquid, CGL coating liquid and CTL coating liquid was coated on an aluminum cylinder by dip coating followed by drying one by one to overlay an undercoat layer having a thickness of 3.5 μm, a CGL having a thickness of 0.2 μm, and CTL having a thickness of 23 μm.

| | |
|---|---|
| Undercoat layer coating liquid | |
| Titanium dioxide | 400 parts |
| Melamine resin | 65 parts |
| Alkyd resin | 120 parts |
| 2-butanone | 400 parts |
| CGL coating liquid | |
| Polyvinyl butyral | 5 parts |
| Bisazo pigment having the following formula (16) | 12 parts |

(16)

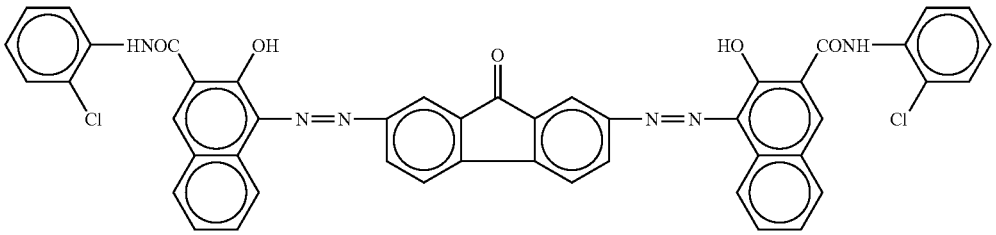

| | |
|---|---|
| 2-butanone | 200 parts |
| Cyclohexanone | 400 parts |
| CTL coating liquid | |
| Polycarbonate | 10 parts |

-continued

| | |
|---|---|
| (Z-form polycarbonate from Teijin Chemical Co., Ltd.) | |
| CTM having the following formula (17) | 10 parts |

(17)

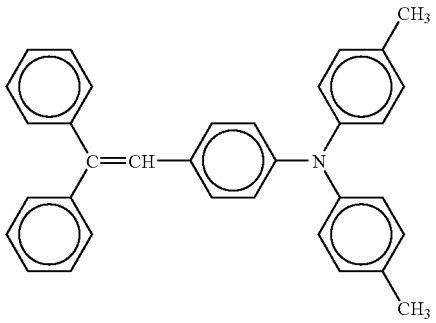

| | |
|---|---|
| Tetrahydrofuran | 100 parts |

Then the following protective layer coating liquid was coated on the CTL by spray coating, followed by drying to form a protective layer having a thickness of about 4 μm.

| Protective layer coating liquid | |
|---|---|
| α-alumina (SUMICORUNDUM AA-03 from Sumitomo Chemical Co., Ltd., average primary particular diameter of 0.3 μm, resistivity of not less than $10^{10}$ Ω · cm, and pH of from 8 to 9) | 2 parts |
| Compound No. 4 illustrated in Table 1 | 0.5 parts |
| Solution of unsaturated polycarboxylic acid polymer (BYK-P104 from BYK Chemie, acid value of about 180 mgKOH/g, and solid content of 50%) | 0.02 parts |
| CTM having formula (17) | 3.5 parts |
| Polycarbonate resin (Z-form polycarbonate resin from Teijin Chemical Co., Ltd.) | 6 parts |
| Tetrahydrofuran | 220 parts |
| Cyclohexanone | 80 parts |

Thus, a photoreceptor of Example 1 was prepared.

Example 2

The procedure for preparation of the photoreceptor in Example 1 was repeated except that the polycarboxylic acid polymer in the protective layer was replaced with 0.02 parts of an unsaturated polycarboxylic acid polymer (BYK-PIOS from BYK Chemie, acid value of 365 mgKOH/g).

Thus, a photoreceptor of Example 2 was prepared.

Example 3

The procedure for preparation of the photoreceptor in Example 1 was repeated except that the polycarboxylic acid polymer in the protective layer was replaced with 0.2 parts of a polyester resin having an acid value of 35 mgKOH/g.

Thus, a photoreceptor of Example 3 was prepared.

Example 4

The procedure for preparation of the photoreceptor in Example 1 was repeated except that the polycarboxylic acid polymer in the protective layer was replaced with 0.2 parts of a polyester resin having an acid value of 50 mgKOH/g.

Thus, a photoreceptor of Example 4 was prepared.

Example 5

The procedure for preparation of the photoreceptor in Example 1 was repeated except that the polycarboxylic acid polymer in the protective layer was replaced with 0.1 parts of an acrylic resin (DIANAL BR-605 from Mitsubishi Rayon Co., Ltd., acid value of 65 mgKOH/g).

Thus, a photoreceptor of Example 5 was prepared.

Example 6

The procedure for preparation of the photoreceptor in Example 1 was repeated except that the polycarboxylic acid polymer in the protective layer was replaced with 0.1 parts of a copolymer of acrylic acid and hydroxyethyl methacrylate having an acid value of 50 mgKOH/g.

Thus, a photoreceptor of Example 6 was prepared.

Example 7

The procedure for preparation of the photoreceptor in Example 1 was repeated except that the polycarboxylic acid polymer in the protective layer was replaced with 0.1 parts of a copolymer of monoester of maleic acid, styrene and butyl acrylate having an acid value of 50 mgKOH/g.

Thus, a photoreceptor of Example 7 was prepared.

Example 8

The procedure for preparation of the photoreceptor in Example 1 was repeated except that the polycarboxylic acid polymer in the protective layer was replaced with 0.1 parts of a styrene-acrylic copolymer (FB-1522 from Mitsubishi Rayon Co., Ltd., acid value of 200 mgKOH/g).

Thus, a photoreceptor of Example 8 was prepared.

Example 9

The procedure for preparation of the photoreceptor in Example 1 was repeated except that the polycarboxylic acid polymer in the protective layer was replaced with 0.02 parts of a solution of an unsaturated polycarboxylic acid polymer (from Fujisawa Pharmaceutical Co., Ltd., acid value of 650 mgKOH/g).

Thus, a photoreceptor of Example 9 was prepared.

Example 10

The procedure for preparation of the photoreceptor in Example 2 was repeated except that the addition amount of the unsaturated polycarboxylic acid polymer solution was changed to 0.001 parts.

Thus, a photoreceptor of Example 10 was prepared.

Example 11

The procedure for preparation of the photoreceptor in Example 2 was repeated except that the addition amount of the unsaturated polycarboxylic acid polymer solution was changed to 0.1 parts.

Thus, a photoreceptor of Example 11 was prepared.

Example 12

The procedure for preparation of the photoreceptor in Example 5 was repeated except that the addition amount of the acrylic resin was changed to 0.5 parts.

Thus, a photoreceptor of Example 12 was prepared.

Example 13

The procedure for preparation of the photoreceptor in Example 1 was repeated except that the filler (i.e., alumina) included in the protective layer was replaced with 2 parts of a titanium oxide having an average primary particle diameter of 0.3 μm (CR-97 from Ishihara Sangyo Kaisha Ltd.).

Thus, a photoreceptor of Example 13 was prepared.

Example 14

The procedure for preparation of the photoreceptor in Example 1 was repeated except that the filler included in the protective layer was replaced with 2 parts of a titanium oxide having an average primary particle diameter of 0.015 μm and treated with a silane coupling agent (MT10OSA from Tayca Corp., ratio of titanium oxide to silane coupling agent 100/20).

Thus, a photoreceptor of Example 14 was prepared.

Example 15

The procedure for preparation of the photoreceptor in Example 1 was repeated except that the filler included in the protective layer was replaced with 2 parts of a silica having an average particle diameter of 0.1 μm (KMPX100 from Shin-Etsu Chemical Co., Ltd.).

Thus, a photoreceptor of Example 15 was prepared.

Example 16

The procedure for preparation of the photoreceptor in Example 1 was repeated except that the binder resin and the CTM included in the protective layer were replaced with 20 parts of a charge transport polymer having the following formula (18).

(18)

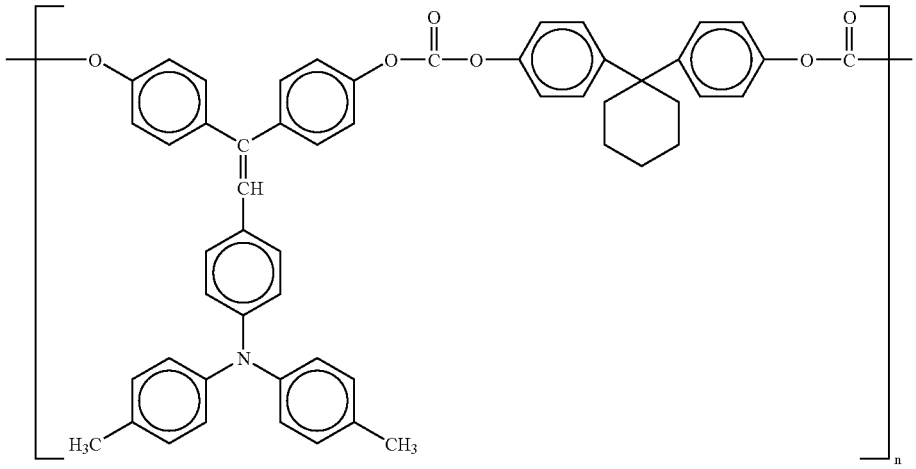

Thus, a photoreceptor of Example 16 was prepared.

Example 17

The procedure for preparation of the photoreceptor in Example 1 was repeated except that the binder resin (i.e., polycarbonate) included in the protective layer was replaced with 10 parts of a polyarylate resin (U POLYMER from Unitika Ltd.)

Thus, a photoreceptor of Example 17 was prepared.

Example 18

The procedure for preparation of the photoreceptor in Example 1 was repeated except that the CGL coating liquid, the CTL coating liquid and the protective layer coating liquid were changed to the following.

Figure 9:
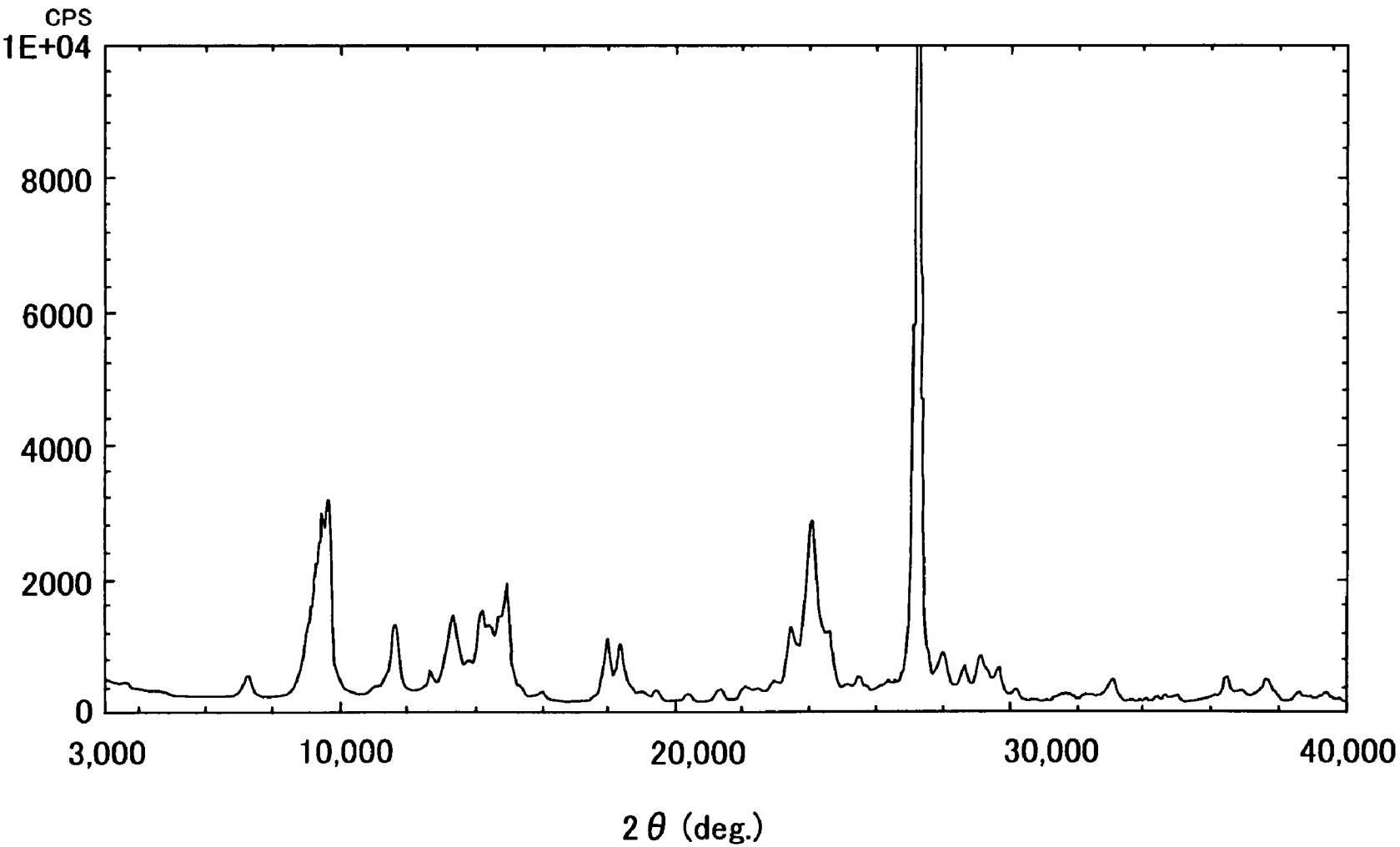
FIG. 9 is an X-ray diffraction spectrum of the titanyl phthalocyanine for use in the photoreceptor of the present application.

| CGL coating liquid | |
|---|---|
| Titanyl phthalocyanine having an X-ray diffraction spectrum illustrated in FIG. 9 | 8 parts |
| Polyvinyl butyral | 5 parts |
| 2-butanone | 400 parts |
| CTL coating liquid | |
| C-form polycarbonate resin | 10 parts |
| CTM having the following formula (19) | 8 parts |

(19)

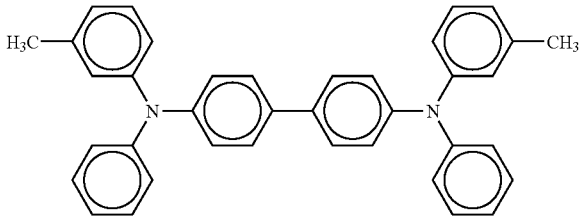

| | |
|---|---|
| Toluene | 70 parts |
| Protective layer coating liquid | |
| Titanium oxide treated with alumina (from Tayca, an average primary particle diameter of 0.035 μm) | 1.5 parts |
| Compound No. 4 illustrated in Table 1 | 0.5 parts |
| Methacrylic acid/methyl methacrylate copolymer (acid value of 50 mgKOH/g) | 0.5 parts |
| CTM having formula (19) | 4 parts |
| Tetrahydrofuran | 250 parts |
| Cyclohexanone | 50 parts |

Thus, a photoreceptor of Example 18 was prepared.

Comparative Example 1

The procedure for preparation of the photoreceptor in Example 1 was repeated except that the protective layer coating liquid were changed to the following.

| Protective layer coating liquid | |
|---|---|
| Alumina (SUMICORUNDUM AA-03 from Sumitomo Chemical Co., Ltd., average primary particular diameter of 0.3 μm) | 2 parts |
| Compound No. 4 illustrated in Table 1 | 0.5 parts |
| CTM having formula (17) | 4 parts |
| Z-form polycarbonate (from Teijin Chemicals Ltd.) | 6 parts |
| Tetrahydrofuran | 220 parts |
| Cyclohexanone | 80 parts |

Thus, a photoreceptor of Comparative Example 1 was prepared.

Comparative Example 2

The procedure for preparation of the photoreceptor in Example 3 was repeated except that the protective layer coating liquid were changed to the following.

| Protective layer coating liquid | |
|---|---|
| Alumina (SUMICORUNDUM AA-03 from Sumitomo Chemical Co., Ltd., average primary particular diameter of 0.3 μm) | 2 parts |
| Compound No. 4 listed in Table 1 | 0.5 parts |
| Polyester resin (acid value of 7 mgKOH/g) | 0.2 parts |
| CTM having formula (17) | 4 parts |
| Z-form polycarbonate (from Teijin Chemicals Ltd.) | 6 parts |
| Tetrahydrofuran | 220 parts |
| Cyclohexanone | 80 parts |

Thus, a photoreceptor of Comparative Example 2 was prepared.

Comparative Example 3

The procedure for preparation of the photoreceptor in Example 1 was repeated except that the protective layer coating liquid were changed to the following.

| Protective layer coating liquid | |
|---|---|
| Alumina (SUMICORUNDUM AA-03 from Sumitomo Chemical Co., Ltd., average primary particular diameter of 0.3 μm) | 2 parts |
| Unsaturated polycarboxylic acid polymer solution (from BYK Chemie, acid value of 180 mgKOH/g) | 0.02 parts |
| CTM having formula (17) | 4 parts |
| Z-form polycarbonate (from Teijin Chemicals Ltd.) | 6 parts |
| Tetrahydrofuran | 220 parts |
| Cyclohexanone | 80 parts |

Thus, a photoreceptor of Comparative Example 3 was prepared.

Example 19

The procedure for preparation of the photoreceptor in Example 1 was repeated except that the compound No. 4 in the protective layer coating liquid was replaced with a compound No. 2 illustrated in Table 1.

Thus, a photoreceptor of Example 19 was prepared.

Example 20

The procedure for preparation of the photoreceptor in Example 1 was repeated except that the compound No. 4 in the protective layer coating liquid was replaced with a compound No. 17 illustrated in Table 2.

Thus, a photoreceptor of Example 20 was prepared.

Example 21

The procedure for preparation of the photoreceptor in Example 1 was repeated except that the compound No. 4 in the protective layer coating liquid was replaced with a compound No. 20 illustrated in Table 2.

Thus, a photoreceptor of Example 21 was prepared.

Example 22

The procedure for preparation of the photoreceptor in Example 1 was repeated except that the compound No. 4 in the protective layer coating liquid was replaced with a compound No. 23 illustrated in Table 2.

Thus, a photoreceptor of Example 22 was prepared.

Example 23

The procedure for preparation of the photoreceptor in Example 1 was repeated except that the compound No. 4 in the protective layer coating liquid was replaced with a compound No. 30 illustrated in Table 3.

Thus, a photoreceptor of Example 23 was prepared.

Evaluation Method

Each of the photoreceptors of Examples 1 to 23 and Comparative Examples 1 to 3 was set in a process cartridge, and the cartridge was set in an image forming apparatus, IMAGIO MF2200 manufactured by Ricoh Co., Ltd., which had been modified such that a scorotron corona charger is used as the charger; and a laser diode emitting light having a wavelength of 655 nm is used as a light source for the imagewise light irradiator. The potential of non-lighted portions of each photoreceptor was controlled so as to be −900 V. A running test in which 50,000 images were continuously produced was performed to evaluate the image qualities of images produced at the beginning and end of the running test. In addition, the potential (PL) of lighted portions (i.e., the residual potential) of each photoreceptor was measured at the beginning and end of the running test. Further, the difference-in thickness of the protective layer before and after the running test was determined to determine the abrasion amount of the protective layer.

The results are shown in Table 4.

TABLE 4

| | At the beginning of running test | | At the end of running test | | |
|---|---|---|---|---|---|
| | $P_L$ (−V) | Image qualities | $P_L$ (−V) | Image qualities | Abrasion (μM) |
| Ex. 1 | 115 | Good | 160 | good | 0.50 |
| Ex. 2 | 110 | Good | 150 | good | 0.51 |
| Ex. 3 | 160 | Good | 225 | good | 0.52 |
| Ex. 4 | 140 | Good | 220 | good | 0.52 |
| Ex. 5 | 145 | Good | 205 | good | 0.51 |
| Ex. 6 | 120 | Good | 200 | good | 0.51 |
| Ex. 7 | 120 | Good | 180 | good | 0.50 |
| Ex. 8 | 130 | Good | 180 | good | 0.56 |
| Ex. 9 | 110 | Good | 155 | good | 0.54 |
| Ex. 10 | 205 | Good | 300 | Low image density | 0.55 |
| Ex. 11 | 105 | Good | 150 | good | 0.52 |
| Ex. 12 | 125 | Good | 200 | good | 0.51 |
| Ex. 13 | 140 | Good | 195 | good | 0.55 |
| Ex. 14 | 130 | Good | 180 | good | 0.72 |
| Ex. 15 | 120 | Good | 175 | good | 0.80 |
| Ex. 16 | 120 | Good | 180 | good | 0.49 |
| Ex. 17 | 140 | Good | 190 | good | 0.52 |
| Ex. 18 | 135 | Good | 200 | good | 0.47 |
| Comp. Ex. 1 | 270 | Slightly low image density | 400 | Very low image density. Image cannot be read. | 1.02 |
| Comp. Ex. 2 | 250 | Low image density | 365 | Very low image density. Image cannot be read. | 0.96 |
| Comp. Ex. 3 | 125 | Good | 160 | Very low image density. | 0.52 |
| Ex. 19 | 120 | Good | 160 | good | 0.51 |

TABLE 4-continued

| | At the beginning of running test | | At the end of running test | | |
|---|---|---|---|---|---|
| | $P_L$ (−V) | Image qualities | $P_L$ (−V) | Image qualities | Abrasion (μM) |
| Ex. 20 | 125 | Good | 165 | good | 0.52 |
| Ex. 21 | 115 | Good | 165 | good | 0.50 |
| Ex. 22 | 115 | Good | 155 | good | 0.51 |
| Ex. 23 | 120 | Good | 160 | good | 0.53 |

As clearly understood from the data as shown in-Table 4, the potential ($P_L$) of lighted potions (i.e., the residual potential) of the photoreceptors of the present invention is relatively low compared to that of comparative photoreceptors. This is because an organic compound having an acid value of from 10 to 700 mgKOH/g is included in the outermost layer. In addition, it is clear that when a compound having formula (1) is added to the outermost layer, the resultant photoreceptors can produce high quality images for a long period of time while the outermost layer is hardly abraded.

In contrast, the photoreceptors, which include no organic compound having an acid value of from 10 to 700 mgKOH/g or include a compound having an acid value less than 10 mgKOH/g, have very high residual potential even at the beginning of the running test, and thereby the resultant images have low image density and poor resolution. In addition, at the end of the running test, the half tone reproducibility of the images seriously deteriorates, and thereby the images cannot be read. Further, the photoreceptors have poor abrasion resistance.

In addition, images were produced using the photoreceptors of Examples 1, 11, and 19 to 23 and Comparative Example 3 were allowed to settle in a desiccator containing air including NOx gasses at a concentration of 50 ppm for four days, to compare the resolution of the images with that of the initial images of the respective photoreceptors.

The results are shown in Table 5.

TABLE 5

| | Resolution of initial images (lines/mm) | Resolution of images after the test (lines/mm) |
|---|---|---|
| Ex. 1 | 8.0 | 8.0 |
| Ex. 11 | 8.0 | 7.2 |
| Comp. Ex. 3 | 8.0 | 2.8 |
| Ex. 19 | 8.0 | 8.0 |
| Ex. 20 | 8.0 | 8.0 |
| Ex. 21 | 8.0 | 8.0 |
| Ex. 22 | 8.0 | 8.0 |
| Ex. 23 | 8.0 | 8.0 |

As clearly understood from the data as shown in Table 5, the photoreceptors including a compound having formula (1) have excellent resistance to NOx gasses. The images produced by the photoreceptor of Example 11, which has relatively large acid equivalent compared to the photoreceptors of Examples 1, and 19 to 23, have relatively low resolution, although the image qualities are still acceptable.

Example 24

The following protective layer coating liquid B was prepared.

| Protective layer coating liquid | |
|---|---|
| Alumina (SUMICORUNDUM AA-03 from Sumitomo Chemical Co., Ltd., average primary particular diameter of 0.3 μm) | 2 parts |
| Compound No.2 illustrated in Table 1 | 0.5 parts |
| Unsaturated polycarboxylic acid polymer solution (from BYK Chemie, acid value of 180 mgKOH/g) | 0.02 parts |
| CTM having formula (17) | 3.5 parts |
| Z-form polycarbonate (from Teijin Chemicals Ltd.) | 6 parts |
| Hydroquinone compound having the following formula (20) | 0.005 parts |
| Tetrahydrofuran | 220 parts |
| Cyclohexanone | 80 parts |

(20)

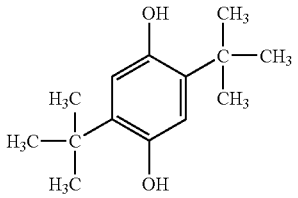

Example 25

The procedure for preparation of the protective layer coating liquid in Example 24 was repeated except that the hydroquinone compound having formula (20) was replaced with a hindered amine compound having the following formula (21).

(21)

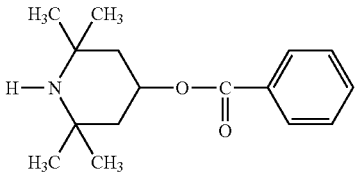

Thus, a protective layer coating liquid C was prepared.

Example 26

The procedure for preparation of the protective layer coating liquid in Example 24 was repeated except that the hydroquinone compound having formula (20) was replaced with an organic sulfur-containing compound having the following formula (22).

(22)

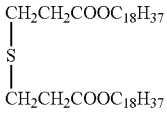

Thus, a protective layer coating liquid D was prepared.

Example 27

The procedure for preparation of the protective layer coating liquid in Example 24 was repeated except that the hydroquinone compound having formula (20) was replaced with a hindered phenol compound having the following formula (23).

(23)

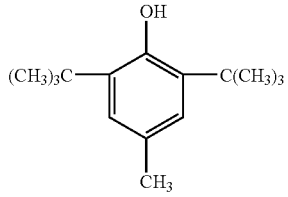

Thus, a protective layer coating liquid E was prepared.

Example 28

The procedure for preparation of the protective layer coating liquid in Example 24 was repeated except that the hydroquinone compound having formula (20) was replaced with an organic phosphorous-containing compound having the following formula (24).

(24)

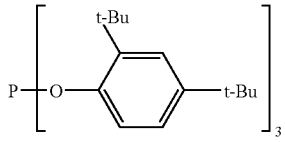

Thus, a protective layer coating liquid F was prepared.

The thus prepared protective layer coating liquids B to F and the protective layer coating liquid (i.e., protective layer coating liquid A) prepared in Examples 1 were allowed to settle in a dark place at room temperature to determine whether the spectral absorption property of each coating liquid changes after the preservation test.

The results are shown in Table 6

TABLE 6

| Protective layer coating liquid | Rate* of change in absorption at 665 nm |
|---|---|
| A | 1.17 |
| B | 1.01 |
| C | 1.01 |
| D | 1.07 |
| E | 1.09 |
| F | 1.10 |

Note
*Change rate = (absorption after the preservation test)/(absorption before the preservation test)

As clearly understood from the data as shown in Table 6, addition of an antioxidant in the protective layer coating liquid improves the preservability of the protective layer coating liquid. In particular, the hydroquinone compound and hindered amine compound have good improving effect.

Example 29

Each of the following undercoat layer coating liquid, a CGL coating liquid and a CTL coating liquid was coated on an aluminum cylinder by dip coating followed by drying one by one to overlay an undercoat layer having a thickness of 3.5 μm, a CGL having a thickness of 0.2 μm, and CTL having a thickness of 23 μm.

| | |
|---|---|
| Undercoat layer coating liquid | |
| Titanium dioxide | 400 parts |
| Melamine resin | 65 parts |
| Alkyd resin | 120 parts |
| 2-butanone | 400 parts |
| CGL coating liquid | |
| Polyvinyl butyral | 5 parts |
| Bisazo pigment having the following formula (16) | 12 parts |

(25)

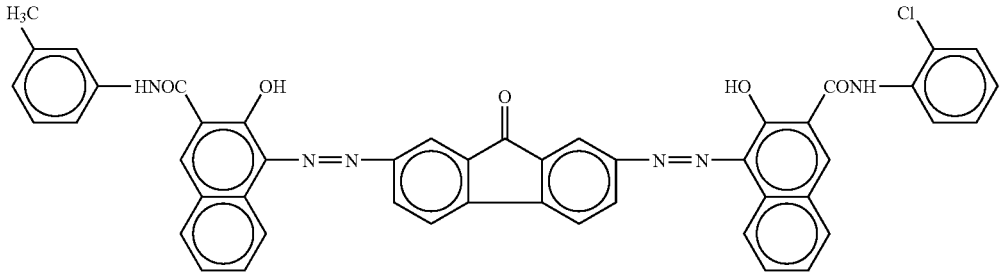

| | |
|---|---|
| 2-butanone | 200 parts |
| Cyclohexanone | 400 parts |
| CTL coating liquid | |
| Polycarbonate | 10 parts |
| (Z-form polycarbonate from Teijin Chemical Co., Ltd.) | 10 parts |
| Compound No. 1 illustrated in Table 1 | |
| Tetrahydrofuran | 100 parts |

Thus, a photoreceptor of Exampl 24 was perpared.

Examples 30 to 43

The procedure for preparation of the photoreceptor in Example 29 was repeated except that the compound No. 1 was replaced with a compound as listed in Table 7.

Thus, photoreceptors of Examples 30 to 43 were prepared.

Evaluation Method

Each of the thus prepared photoreceptors of Examples 29 to 43 was set in a process cartridge, and the cartridge was set in an image forming apparatus, IMAGIO MF2200 manufactured by Ricoh Co., Ltd., which had been modified such that a scorotron corona charger is used as the charger; and a laser diode emitting light having a wavelength of 655 nm is used as a light source for the imagewise light irradiator. The potential of non-lighted portions of each photoreceptor was controlled so as to be −800 V. A running test in which 100,000 images were continuously produced was performed to evaluate the image qualities of images produced at the beginning and end of the running test. In addition, the potential ($P_L$) of lighted portions (i.e., the residual potential) of each photoreceptor was measured at the beginning and end of the running test. Further, the difference in thickness of the protective layer before and after the running test was determined to determine the abrasion amount of the protective layer.

The results are shown in Table 7.

TABLE 7

| | | At the beginning of the running test | | At the end of the running test | |
|---|---|---|---|---|---|
| | Compound No. | $P_L$ (−V) | Image qualities | $P_L$ (−V) | Image qualities |
| Ex. 29 | 1 | 105 | Good | 125 | good |
| Ex. 30 | 2 | 110 | Good | 135 | good |
| Ex. 31 | 3 | 100 | Good | 140 | good |
| Ex. 32 | 4 | 95 | Good | 120 | good |
| Ex. 33 | 6 | 95 | Good | 125 | Slightly low image density |
| Ex. 34 | 11 | 105 | Good | 135 | good |
| Ex. 35 | 14 | 105 | Good | 130 | good |
| Ex. 36 | 16 | 125 | Good | 155 | Slightly low image density |
| Ex. 37 | 17 | 100 | Good | 120 | good |
| Ex. 38 | 21 | 120 | Good | 155 | Slightly low image density |
| Ex. 39 | 23 | 100 | Good | 165 | Slightly low image density |
| Ex. 40 | 26 | 115 | Good | 140 | good |
| Ex. 41 | 29 | 105 | Good | 160 | Slightly low image density |
| Ex. 42 | 31 | 120 | Good | 130 | good |
| Ex. 43 | 35 | 100 | Good | 135 | good |

Examples 44

The procedure for preparation and evaluation of the photoreceptor in Example 29 was repeated except that the CTL coating liquid was replaced with the following.

| CTL coating liquid | |
|---|---|
| Polycarbonate (Z-form polycarbonate from Teijin Chemical Co., Ltd.) | 10 parts |
| Compound No. 1 illustrated in Table 1 | 1 part |
| CTM having formula (17) | 9 parts |
| Tetrahydrofuran | 100 parts |

Thus, a photoreceptor of Example 44 was prepared.

Examples 45 to 58

The procedure for preparation of the photoreceptor in Example 44 was repeated except that the compound No. 1 was replaced with a compound as listed in Table 8.

The evaluation results are shown in Table 8.

TABLE 8

| | Compound No. | At the beginning of the running test $P_L$ (−V) | Image qualities | At the end of the running test $P_L$ (−V) | Image qualities |
|---|---|---|---|---|---|
| Ex. 44 | 1 | 95 | Good | 105 | good |
| Ex. 45 | 2 | 100 | Good | 110 | good |
| Ex. 46 | 3 | 100 | Good | 105 | good |
| Ex. 47 | 4 | 95 | Good | 105 | good |
| Ex. 48 | 6 | 100 | Good | 110 | good |
| Ex. 49 | 11 | 100 | Good | 110 | good |
| Ex. 50 | 14 | 100 | Good | 115 | good |
| Ex. 51 | 16 | 100 | Good | 105 | good |
| Ex. 52 | 17 | 100 | Good | 110 | good |
| Ex. 53 | 21 | 105 | Good | 110 | good |
| Ex. 54 | 23 | 100 | Good | 105 | good |
| Ex. 55 | 26 | 115 | Good | 105 | good |
| Ex. 56 | 29 | 100 | Good | 115 | good |
| Ex. 57 | 31 | 105 | Good | 110 | good |
| Ex. 58 | 35 | 110 | Good | 115 | good |

Examples 59 to 62

The procedure for preparation and evaluation of the photoreceptor in Example 44 was repeated except that the compound No. 1 was replaced with the compound described in Table 9 and the addition amount of the CTM having formula (17) was changed to 7 parts.

The evaluation results are shown in Table 9.

TABLE 9

| | Compound No. | At the beginning of the running test $P_L$ (−V) | Image qualities | At the end of the running test $P_L$ (−V) | Image qualities |
|---|---|---|---|---|---|
| Ex. 59 | 4 | 100 | Good | 105 | good |
| Ex. 60 | 17 | 100 | Good | 105 | good |
| Ex. 61 | 25 | 105 | Good | 115 | good |
| Ex. 62 | 37 | 105 | Good | 110 | good |

Examples 63 to 66

The procedure for preparation and evaluation of the photoreceptors in Examples 59 to 62 was repeated except that the ratio of the compound to the CTM having formula (17) was changed from 1/7 to 5/5.

The evaluation results are shown in Table 10.

TABLE 10

| | Compound No. | At the beginning of the running test $P_L$ (−V) | Image qualities | At the end of the running test $P_L$ (−V) | Image qualities |
|---|---|---|---|---|---|
| Ex. 63 | 4 | 100 | Good | 105 | good |
| Ex. 64 | 17 | 105 | Good | 110 | good |
| Ex. 65 | 25 | 110 | Good | 135 | good |
| Ex. 66 | 37 | 120 | Good | 120 | good |

Examples 67 to 70

The procedure for preparation and evaluation of the photoreceptor in Example 44 was repeated except that the compound No. 1 was replaced with the compound described in Table 11 and the CTM having formula (17) was replaced with a CTM having the following formula (26).

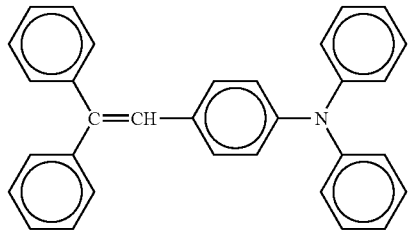

(26)

The evaluation results are shown in Table 11.

TABLE 11

| | Compound No. | At the beginning of the running test $P_L$ (−V) | Image qualities | At the end of the running test $P_L$ (−V) | Image qualities |
|---|---|---|---|---|---|
| Ex. 67 | 4 | 100 | Good | 110 | Good |
| Ex. 68 | 17 | 100 | Good | 105 | Good |
| Ex. 69 | 25 | 105 | Good | 125 | good |
| Ex. 70 | 37 | 110 | Good | 115 | good |

Examples 71 to 74

The procedure for preparation and evaluation of the photoreceptor in Example 44 was repeated except that the compound No. 1 was replaced with the compound described in Table 12 and the CTM having formula (17) was replaced with a CTM having the following formula (27).

(27)

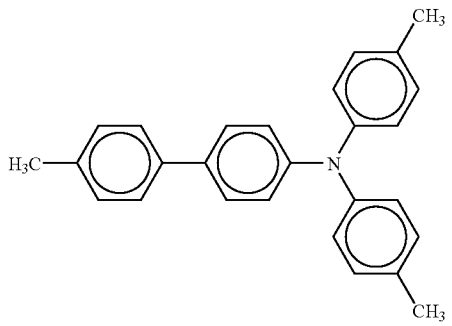

The evaluation results are shown in Table 12.

TABLE 12

| | Compound No. | At the beginning of the running test $P_L$ (−V) | Image qualities | At the end of the running test $P_L$ (−V) | Image qualities |
|---|---|---|---|---|---|
| Ex. 71 | 4 | 100 | Good | 115 | Good |
| Ex. 72 | 17 | 105 | Good | 115 | Good |
| Ex. 73 | 25 | 110 | Good | 130 | good |
| Ex. 74 | 37 | 105 | Good | 120 | good |

Examples 75 to 77

The procedure for preparation and evaluation of the photoreceptor in Example 44 was repeated except that the compound No. 1 was replaced with the compound described in Table 13 and the CTM having formula (17) and the polycarbonate were replaced with 19 parts of a CTM having the following formula (28).

The evaluation results are shown in Table 13.

n

TABLE 13

| | Compound No. | At the beginning of the running test $P_L$ (−V) | Image qualities | At the end of the running test $P_L$ (−V) | Image qualities |
|---|---|---|---|---|---|
| Ex. 75 | 3 | 95 | Good | 120 | Good |
| Ex. 76 | 8 | 100 | Good | 125 | Good |
| Ex. 77 | 17 | 95 | Good | 115 | Good |

Examples 78 and 79

The procedure for preparation and evaluation of the photoreceptor in Example 44 was repeated except that the compound No. 1 was replaced with the compound described in Table 14 and the CTM having formula (17) and the polycarbonate were replaced with 19 parts of a CTM having the following formula (29).

(28)

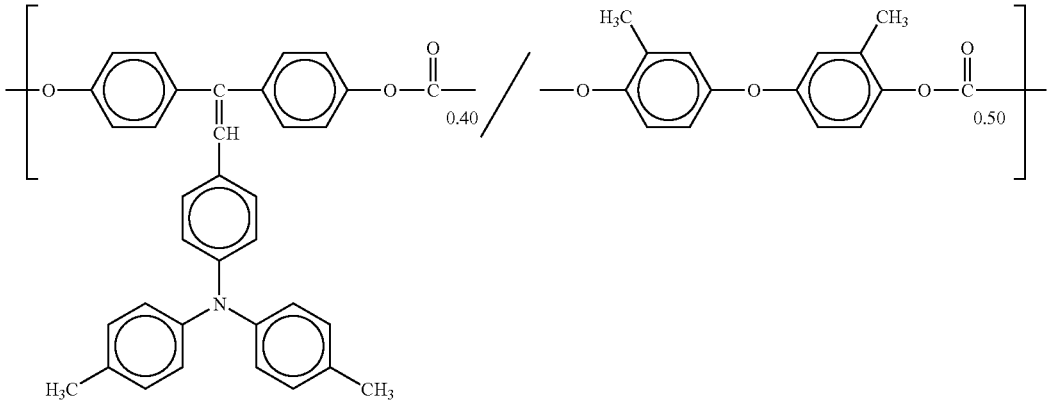

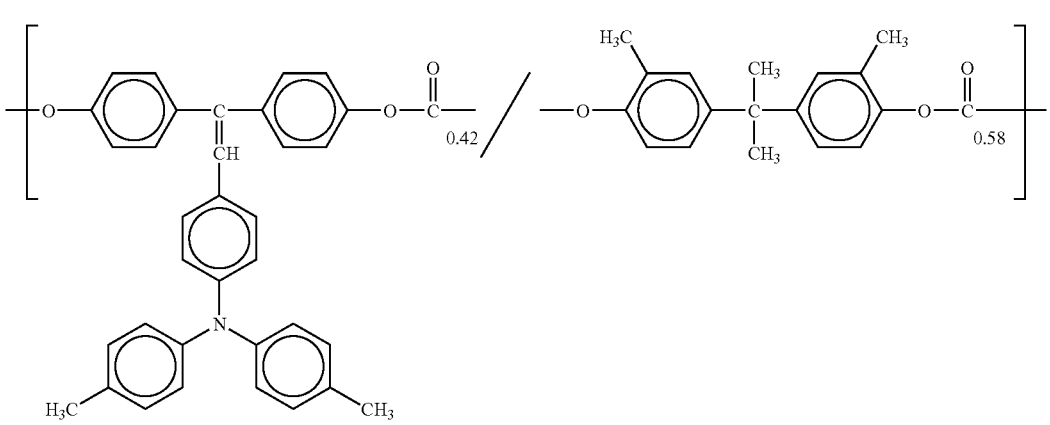

(29)

The evaluation results are shown in Table 14.

TABLE 14

| | Compound No. | At the beginning of the running test $P_L$ (−V) | Image qualities | At the end of the running test $P_L$ (−V) | Image qualities |
|---|---|---|---|---|---|
| Ex. 78 | 4 | 100 | Good | 125 | Good |
| Ex. 79 | 17 | 100 | Good | 120 | Good |

Examples 80 and 81

The procedure for preparation and evaluation of the photoreceptor in Example 44 was repeated except that the compound No. 1 was replaced with the compound described in Table 15 and the CTM having formula (17) and the polycarbonate were replaced with 19 parts of a CTM having the following formula (30).

The evaluation results are shown in Table 15.

TABLE 15

| | Compound No. | At the beginning of the running test $P_L$ (−V) | Image qualities | At the end of the running test $P_L$ (−V) | Image qualities |
|---|---|---|---|---|---|
| Ex. 80 | 17 | 105 | Good | 135 | Good |
| Ex. 81 | 36 | 100 | Good | 120 | Good |

Examples 82 and 85

The procedure for preparation and evaluation of the photoreceptor in Example 44 was repeated except that the compound No. 1 was replaced with the compound described in Table 16 and the binder resin (polycarbonate) was replaced with 10 parts of a polyarylate resin (U POLYMER from Unitika Ltd.

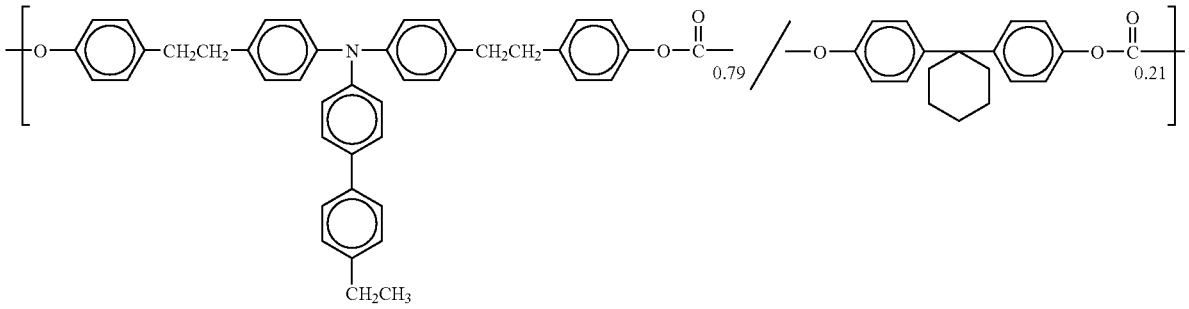

(30)

The evaluation results are shown in Table 16.

TABLE 16

| | Compound No. | At the beginning of the running test $P_L$ (−V) | Image qualities | At the end of the running test $P_L$ (−V) | Image qualities |
|---|---|---|---|---|---|
| Ex. 82 | 8 | 110 | Good | 125 | Good |
| Ex. 83 | 17 | 100 | Good | 105 | Good |
| Ex. 84 | 24 | 95 | Good | 115 | Good |
| Ex. 85 | 30 | 105 | Good | 125 | Good |

Examples 86 and 87

The procedure for preparation and evaluation of the photoreceptor in Example 29 was repeated except that the CGL coating liquid and the CTL coating liquid were changed to the following.

| | |
|---|---|
| CGL coating liquid | |
| Titanyl phthalocyanine having an X-ray diffraction spectrum as illustrated in FIG. 9 | 8 parts |
| Polyvinyl butyral (S-LEC BX-1 from Sekisui Chemical Co., Ltd.) | 5 parts |
| 2-butanone | 400 parts |
| CTL coating liquid | |
| Z-form polycarbonate resin | 10 parts |
| Compound No. 4 or 17 illustrated in Table 1 or 2 | 1 part |
| CTM having formula (17) | 7 parts |
| Toluene | 70 parts |

The evaluation results are shown in Table 17.

TABLE 17

| | Compound No. | At the beginning of the running test $P_L$ (−V) | Image qualities | At the end of the running test $P_L$ (−V) | Image qualities |
|---|---|---|---|---|---|
| Ex. 86 | 4 | 115 | Good | 130 | Good |
| Ex. 87 | 17 | 110 | Good | 125 | Good |

Examples 88 and 89

The procedure for preparation and evaluation of the photoreceptor in Example 86 was repeated except that the CTM in the CTL coating liquid was replaced with a CTM having formula (19).

The evaluation results are shown in Table 18.

TABLE 18

| | Compound No. | At the beginning of the running test $P_L$ (−V) | Image qualities | At the end of the running test $P_L$ (−V) | Image qualities |
|---|---|---|---|---|---|
| Ex. 88 | 4 | 110 | Good | 125 | Good |
| Ex. 89 | 17 | 105 | Good | 130 | Good |

Comparative Example 4

The procedure for preparation and evaluation of the photoreceptor in Example 44 was repeated except that the compound No. 1 was replaced with a stilbene compound having the following formula (31).

(31)

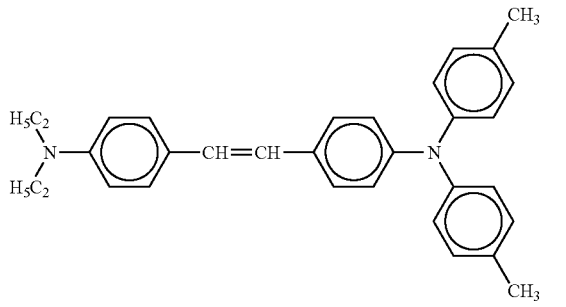

Thus, a photoreceptor of Comparative Example 4 was prepared. The evaluation results are shown in Table 19.

Comparative Example 5

The procedure for preparation and evaluation of the photoreceptor in Example 44 except that the compound No. 1 was not included in the CTL coating liquid and the addition amount of the CTM was changed from 9 parts to 10 parts.

Thus, a photoreceptor of Comparative Example 5 was prepared. The evaluation results are shown in Table 19.

Comparative Example 6

The procedure for preparation and evaluation of the photoreceptor in Example 63 except that the compound No. 4 was replaced with a tetraphenylmethane compound having the following formula (32).

(32)

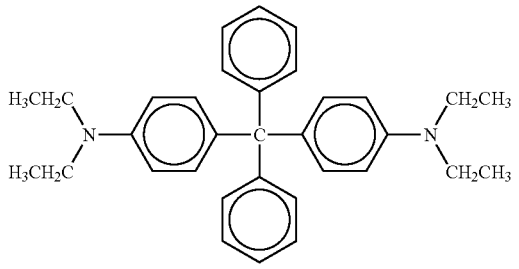

Thus, a photoreceptor of Comparative Example 6 was prepared. The evaluation results are shown in Table 19.

Comparative Example 7

The procedure for preparation and evaluation of the photoreceptor in Example 44 except that the compound No. 1 was replaced with a hindered amine-based antioxidant having the following formula (33).

(33)

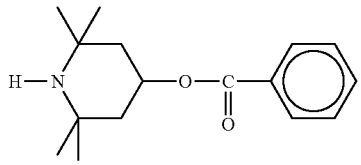

Thus, a photoreceptor of Comparative Example 7 was prepared. The evaluation results are shown in Table 19.

TABLE 19

| | At the beginning of the running test | | At the end of the running test | |
|---|---|---|---|---|
| | $P_L$ (−V) | Image qualities | $P_L$ (−V) | Image qualities |
| Comp. Ex. 4 | 320 | Low image density | 550 | Very low image density. Images cannot be read. |
| Comp. Ex. 5 | 100 | Good | 135 | Poor resolution |
| Comp. Ex. 6 | 200 | Low image density. Good resolution. | 285 | Low image density. Good resolution. |
| Comp. Ex. 7 | 250 | Low image density. Poor resolution. | 480 | Very low image density. Images cannot be read. |

As can be understood from the data in Tables 7-19, the photoreceptors of the present invention have low residual potential after long repeated use, and can stably produce high quality images for a long period of time.

In contrast, the comparative photoreceptors have high residual potential and cause a low image density problem and/or a low resolution problem. After the 100,000-sheet running test, the half-tone reproducibility of the images produced by the comparative photoreceptors deteriorates, and thereby the images cannot be read. The photoreceptor of Comparative Example 5 has a relatively low residual potential even after the running test, but the resolution of the resultant images deteriorates.

In addition, images were produced using the photoreceptors of Examples 29, 47, 56, 69, 73, 77, 79, 80, 85, 87 and 89 and Comparative Example 5 were allowed to settle in a desiccator containing air including NOx gasses at a concentration of 50 ppm for four days, to compare the resolution of the images with that of the initial images of the respective photoreceptors.

The results are shown in Table 20.

TABLE 20

| | Initial Image qualities | Image qualities after the preservation test |
|---|---|---|
| Ex. 29 | Good | Good |
| Ex. 47 | Good | Good |
| Ex. 56 | Good | Good |
| Ex. 69 | Good | Good |
| Ex. 73 | Good | Good |
| Ex. 77 | Good | Good |
| Ex. 79 | Good | Good |
| Ex. 80 | Good | Good |
| Ex. 85 | Good | Good |
| Ex. 87 | Good | Good |
| Ex. 89 | Good | Good |
| Comp. Ex. 5 | Good | Resolution seriously deteriorated. |

As clearly understood from the data as shown in Table 20, the photoreceptors including a compound having formula (1) have excellent resistance to NOx gasses (i.e., images having good resolution can be produced even after the photoreceptors are exposed to NOx). In contrast, the comparative photoreceptor has poor resistance to NOx gasses (i.e., the images have poor resolution after the photoreceptors are exposed to NOx).

This document claims priority and contains subject matter related to Japanese Patent Application No. 2003-057682, filed on Mar. 4, 2003, incorporated herein by reference.

Having now fully described the invention, it will be apparent to one of ordinary skill in the art that many changes and modifications can be made thereto without departing from the spirit and scope of the invention as set forth therein.

What is claimed is:

1. A photoreceptor which includes an electroconductive substrate, and a photosensitive layer located overlying the substrate, wherein the photosensitive layer comprises a diamine compound having the following formula (1):

(1)

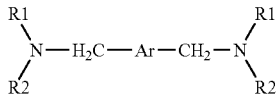

wherein one of R1 and R2 independently represents a substituted or unsubstituted alkyl group, and the other of R1 and R2 independently represents a substituted or unsubstituted aromatic hydrocarbon group, and Ar represents a substituted or unsubstituted aromatic hydrocarbon group.

2. The photoreceptor according to claim 1, wherein the photosensitive layer further comprises a charge transport material.

3. The photoreceptor according to claim 2, wherein the charge transport material is a compound selected from the group consisting of stilbene compounds having the following formula:

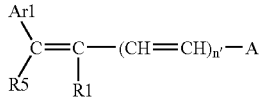

wherein n' is 0 or 1; R1 represents a hydrogen atom, an alkyl group or a substituted or unsubstituted phenyl group; Ar1 represents a substituted or unsubstituted aromatic hydrocarbon group; R5 represents an alkyl group having from 1 to 4 carbon atoms, or a substituted or unsubstituted aromatic hydrocarbon group, wherein Ar1 and R5 optionally share bond connectivity to form a ring; and A represents a 9-anthryl group, a substituted or unsubstituted carbazolyl group or a group having one of the following formulae:

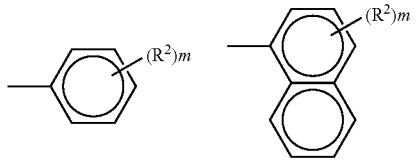

wherein $R^2$ represents a hydrogen atom, an alkyl group, an alkoxy group, a halogen atom or a group having a formula of $=N(R^3)(R^4)$, wherein $R^3$ and $R^4$ independently represent a substituted or unsubstituted aromatic hydrocarbon group, and $R^3$ and $R^4$ optionally share bond connectivity to form a ring; and m is an integer of from 1 to 3, wherein when m is not less than 2, each of $R^2$ is the same or different from the others, and wherein A and R1 optionally share bond connectivity to form a ring when n' is 0;

aminobiphenyl compounds having the following formula:

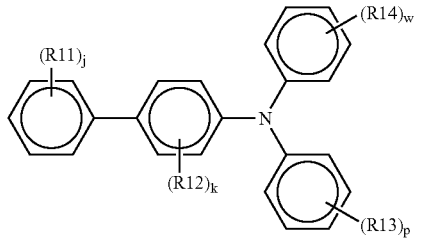

wherein R11, R13 and R14 independently represent a hydrogen atom, an amino group, an alkoxy group, a thioalkoxy group, an aryloxy group, a methylenedioxy group, a substituted or unsubstituted alkyl group, a halogen atom or a substituted or unsubstituted aromatic hydrocarbon group; R12 represents a hydrogen atom, an alkoxy group, a substituted or unsubstituted alkyl group or a halogen atom; and j, k, p and w are independently an integer of from 1 to 4, wherein each of R11, R12, R13 and R14 may be the same or different from the others when j, k, p and w are an integer of from 2 to 4;

charge transport polymers having the following formula:

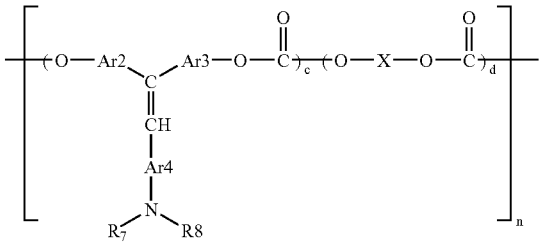

wherein R7 and R8 independently represent a substituted or unsubstituted aromatic hydrocarbon group; Ar2, Ar3 and Ar4 independently represent an arylene group; c is a number of from 0.1 to 1.0 and d is a number of from 0 to 0.9; n is an integer of from 5 to 5000; and X represents a divalent aliphatic group, a divalent alicyclic group or a divalent group having the following formula):

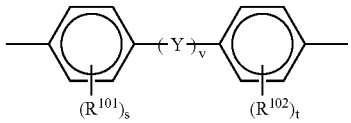

wherein R101 and R102 independently represent a substituted or unsubstituted alkyl group, a substituted or unsubstituted aromatic hydrocarbon group, or a halogen atom; s and t represent 0 or an integer of from 1 to 4; v is 0 or 1; and Y represents a linear alkylene group, a branched alkylene group, a cyclic alkylene group, —O—, —S—, —SO—, —SO2—, —CO—, —CO—O-Z-O—CO—(Z represents a divalent aliphatic group), or a group having the following formula:

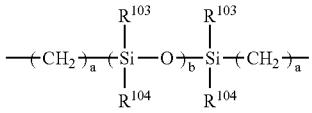

wherein a is an integer of from 1 to 20; b is an integer of from 1 to 2000; and R103 and R104 independently represent a substituted or unsubstituted alkyl group, or a substituted or unsubstituted aromatic hydrocarbon group, wherein R101, R102, R103 and R104 may be the same or different from the others; and charge transport polymers having the following formula:

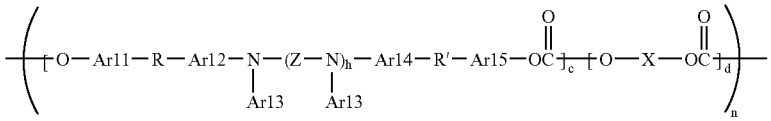

wherein Ar11, Ar12, Ar13, Ar14 and Ar15 independently represent a substituted or unsubstituted aromatic hydrocarbon group; Z represents an aromatic group or a group —Ar16-Za-Arl6—, wherein Ar16 represents a substituted or unsubstituted aromatic hydrocarbon group, Za represents O, S or an alkylene group; R and R' independently represent a linear or branched alkylene group; h is 0 or 1; and X, c, d and n are defined above.

4. An image forming method comprising:

charging the photoreceptor according to claim 1;

irradiating the charged photoreceptor with imagewise light to form an electrostatic latent image on the photoreceptor;

developing the electrostatic latent image with a developer including a toner to form a toner image on the photoreceptor; and transferring the toner image on a receiving material.

5. An image forming apparatus comprising:

the photoreceptor according to claim 1;

a charger configured to charge the photoreceptor;

a light irradiator configured to irradiate the charged photoreceptor with imagewise light to form an electrostatic latent image on the photoreceptor;

an image developer configured to develop the electrostatic latent image with a developer to form a toner image on the photoreceptor; and a transferring device configured to transfer the toner image onto a receiving material.

6. The image forming apparatus according to claim 5, wherein the light irradiator comprises at least one of a laser diode and a light emitting diode.

7. A process cartridge comprising:

the photoreceptor according to claim 1; and at least one a charger configured to charge the photoreceptor; a light irradiator configured to irradiate the charged photoreceptor with imagewise light to form an electrostatic latent image on the photoreceptor; an image developer configured to develop the electrostatic latent image with a developer to form a toner image on the photoreceptor, a transfer device configured to transfer the toner image onto a receiving material, a cleaner configured to clean a surface of the photoreceptor, and a discharger configured to discharge the charges remaining on the photoreceptor after the toner image is transferred.

8. A photoreceptor comprising:

an electroconductive substrate;

a photosensitive layer located overlying the electroconductive substrate; and optionally a protective layer located overlying the photosensitive layer, wherein an outermost layer of the photoreceptor comprises a filler, an organic compound having an acid value of from 10 to 700 mgKOH/g and a diamine compound having the following formula (1):

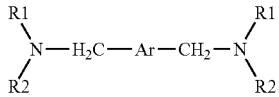

(1)

wherein R1 and R2 independently represent a substituted or unsubstituted alkyl group, or a substituted or unsubstituted aromatic hydrocarbon group, wherein at least one of R1 and R2 is a substituted or unsubstituted aromatic hydrocarbon group and R1 and R2 can optionally share bond connectivity to form a substituted or unsubstituted ring including a nitrogen atom; and Ar represents a substituted or unsubstituted aromatic hydrocarbon group.

9. The photoreceptor according to claim 8, wherein the photosensitive layer is the outermost layer.

10. The photoreceptor according to claim 8, including the protective layer, wherein the protective layer is the outermost layer.

11. The photoreceptor according to claim 8, wherein the organic compound having an acid value of from 10 to 700 mgKOH/g is a polycarboxylic acid.

12. The photoreceptor according to claim 11, wherein the polycarboxylic acid is a material selected from the group consisting of polyester resins, polyester copolymers, acrylic resins, and acrylic copolymers, which have a plurality of carboxyl groups.

13. The photoreceptor according to claim 8, wherein the outermost layer further comprises a fatty acid.

14. The photoreceptor according to claim 8, wherein the filler an inorganic pigment.

15. The photoreceptor according to claim 14, wherein the inorganic pigment compnses a metal oxide.

16. The photoreceptor according to claim 14, wherein the inorganic pigment has a pH not less than 5.

17. The photoreceptor according to claim 14, wherein the inorganic pigment has a dielectric constant not less than 5.

18. The photoreceptor according to claim 8, wherein the filler has an average primary particle diameter of from 0.01 to 0.5 μm.

19. The photoreceptor according to claim 8, wherein the outermost layer comprises a charge transport material.

20. The photoreceptor according to claim 19, wherein the charge transport material is a charge transport polymer material.

21. The photoreceptor according to claim 8, wherein the outermost layer further comprises a binder resin selected from the group consisting of polycarbonate resins and polyarylate resins.

22. The photoreceptor according to claim 8, wherein the outermost layer further comprises an antioxidant selected from the group consisting of hydroquinone compounds and hindered amine compounds.

23. An image forming method comprising:

charging the photoreceptor according to claim 8;

irradiating the charged photoreceptor with imagewise light to form an electrostatic latent image on the photoreceptor;

developing the electrostatic latent image with a developer including a toner to form a toner image on the photoreceptor; and transferring the toner image on a receiving material.

24. An image forming apparatus comprising:

the photoreceptor according to claim 8;

a charger configured to charge the photoreceptor;

a light irradiator configured to irradiate the charged photoreceptor with imagewise light to form an electrostatic latent image on the photoreceptor;

an image developer configured to develop the electrostatic latent image with a developer to form a toner image on the photoreceptor; and a transferring device configured to transfer the toner image onto a receiving material.

25. The image forming apparatus according to claim 24, wherein the light irradiator comprises at least one of a laser diode and a light emitting diode.

26. A process cartridge comprising:

the photoreceptor according to claim 8; and at least one a charger configured to charge the photoreceptor; a light irradiator configured to irradiate the charged photoreceptor with imagewise light to form an electrostatic latent image on the photoreceptor; an image developer configured to develop the electrostatic latent image with a developer to form a toner image on the photoreceptor, a transfer device configured to transfer the toner image onto a receiving material, a cleaner configured to clean a surface of the photoreceptor, and a discharger configured to discharge the charges remaining on the photoreceptor after the toner image is transferred.

27. A method for manufacturing the photoreceptor according to claim 8, comprising:

preparing an outermost layer coating liquid comprising a solvent, the filler, the organic compound having an acid value of from 10 to 700 mgKOH/g, a diamine compound having formula (1), and an antioxidant; and coating the outermost layer coating liquid followed by drying to form the outermost layer.

28. The method according to claim 27, wherein the antioxidant is a compound selected from the group consisting of hydroquinone compounds and hindered amine compounds.

29. A photoreceptor which includes an electroconductive substrate, and a photosensitive layer located overlying the substrate, wherein the photosensitive layer comprises a diamine compound having the following formula (1):

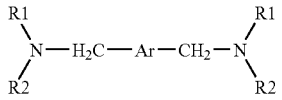

(1)

wherein R1 and R2 independently represent a substituted or unsubstituted alkyl group, or a substituted or unsubstituted aromatic hydrocarbon group, wherein at least one of R1 and R2 is a substituted or unsubstituted aromatic hydrocarbon group and R1 and R2 can optionally share bond connectivity to form a substituted or unsubstituted ring including a nitrogen atom; and Ar represents a substituted or unsubstituted aromatic hydrocarbon group other than a substituted or unsubstituted phenyl group.

30. A photoreceptor which includes an electroconductive substrate, and a photosensitive layer located overlying the substrate, wherein the photosensitive layer comprises a diamine compound having the following formula (1):

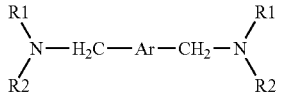

(1)

wherein R1 and R2 independently represent a substituted or unsubstituted aromatic hydrocarbon group, and share bond connectivity to form a substituted or unsubstituted ring including a nitrogen atom; and Ar represents a substituted or unsubstituted aromatic hydrocarbon group.

31. A photoreceptor which includes an electroconductive substrate, and a photosensitive layer located overlying the substrate, wherein the photosensitive layer comprises a diamine compound having the following formula (1):

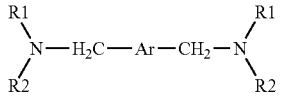

(1)

wherein R1 and R2 independently represent a substituted or unsubstituted aromatic hydrocarbon group, which are not both substituted or unsubstituted phenyl, or are not substituted or unsubstituted phenyl and not substituted or unsubstituted naphthyl, respectively.

* * * * *